US007096538B2

(12) United States Patent
Liang et al.

(10) Patent No.: US 7,096,538 B2
(45) Date of Patent: Aug. 29, 2006

(54) VEHICLE DOOR HINGE SYSTEM

(75) Inventors: Chuan Liang, Scarborough (CA); Robert H. Mooy, Alliston (CA)

(73) Assignee: Ventra Group Inc., Bedford ( * ) Notice: Subject to any disclaimer, the term of this patent is extended or adjusted under 35 U.S.C. 154(b) by 528 days.

(21) Appl. No.: 10/225,456

(22) Filed: Aug. 22, 2002

(65) Prior Publication Data

US 2003/0056323 A1 Mar. 27, 2003

Related U.S. Application Data

(60) Provisional application No. 60/314,317, filed on Aug. 24, 2001.

(51) Int. Cl.
*E05F 1/08* (2006.01)

(52) U.S. Cl. ..... 16/366; 16/287; 296/146.11

(58) Field of Classification Search ..... 49/246, 49/248; 16/287, 335, 341, 350, 371, 366, 16/334, 368, 369, 374, 376, 331, 332, 323, 16/324; 296/146.1, 146.11, 146.12, 146.13
See application file for complete search history.

(56) References Cited

U.S. PATENT DOCUMENTS

| | | | | |
|---|---|---|---|---|
| 521,772 | A | 6/1894 | Vaughan | |
| 1,735,696 | A | 11/1929 | Ridley | |
| 1,961,205 | A | 6/1934 | De Vizcaya | |
| 2,870,477 | A | 1/1959 | Anthony et al. | |
| 3,085,297 | A | 4/1963 | Linderfelt | |
| 3,150,408 | A | 9/1964 | Belsky | |
| 3,470,579 | A | 10/1969 | Cencioni | |
| 3,619,853 | A | 11/1971 | Merrill | |
| 3,651,539 | A | 3/1972 | Breunich et al. | |
| 4,470,170 | A | 9/1984 | Gerteis | |
| 4,495,674 | A | 1/1985 | Haddock, Jr. | |
| 4,655,499 | A | 4/1987 | Piper | |
| 4,719,665 | A | 1/1988 | Bell | |
| 4,744,127 | A | 5/1988 | Shadley | |
| 4,928,350 | A | 5/1990 | Morgan | |
| 4,930,836 | A | 6/1990 | Grinn | |
| 5,346,272 | A | 9/1994 | Priest et al. | |
| 5,404,618 | A * | 4/1995 | Heiler et al. | 16/261 |
| 5,491,875 | A | 2/1996 | Siladke et al. | |
| 5,561,887 | A | 10/1996 | Neag et al. | |
| 5,611,114 | A | 3/1997 | Wood, Jr. et al. | |
| 5,632,065 | A | 5/1997 | Siladke et al. | |
| 5,685,046 | A | 11/1997 | Neag et al. | |
| 5,876,086 | A | 3/1999 | Lagrou et al. | |
| 5,901,415 | A | 5/1999 | Morrison et al. | |

(Continued)

*Primary Examiner*—Robert J. Sandy
*Assistant Examiner*—Andre' L. Jackson
(74) *Attorney, Agent, or Firm*—Pillsbury Winthrop Shaw Pittman, LLP

(57) ABSTRACT

A door hinge system for supporting a vehicle door on a vehicle body is provided that allows the door to moved between (a) a fully closed position wherein the door is positioned in covering relation with respect to a door opening in the vehicle body, (b) a fully opened position wherein the door is moved out of the covering relation and is positioned substantially alongside the vehicle body, and (c) an intermediate position between the fully open and fully closed positions wherein the door is moved out of the covering relation and extends generally outwardly away from the vehicle body. The hinge system includes a pair of hinge assemblies, which each include (a) a body mounting structure configured to be mounted to the vehicle body, (b) a door mounting structure configured to be mounted to the vehicle door, and (c) a dual pivot swing arm.

61 Claims, 20 Drawing Sheets

U.S. PATENT DOCUMENTS 5,915,441 A 6/1999 Schlack
5,943,739 A 8/1999 Vandergriff
6,038,738 A 3/2000 Neag et al.
6,591,451 B1 * 7/2003 Gruber et al. ..... 16/262
6,591,452 B1 * 7/2003 Jacquin ..... 16/332
6,609,748 B1 * 8/2003 Azzouz et al. ..... 296/146.1
6,681,448 B1 * 1/2004 Liang ..... 16/336

* cited by examiner

VEHICLE DOOR HINGE SYSTEM

The present application claims priority to U.S. Provisional Application of Robert H. MOOY, Application No. 60/314,317, filed Aug. 24, 2001, the entirety of which is hereby incorporated into the present application by reference.

FIELD OF THE INVENTION

The present invention relates generally to a hinge assembly for a vehicle door and, more particularly, to hinge assembly for a vehicle door.

BACKGROUND OF THE INVENTION

Some automobiles have need of a door that may swing open greater than 90°. A specific example is a truck with an extended cab. Rear doors for an extended cab are generally appreciably narrower than front doors and as such, may need to be swung open close to 180° in order to facilitate loading bulky items and people into the extended area of the cab. Hinges that allow for close to 180° of movement are generally not constructed to rigidly restrain movement of the door slightly past the fully open position. In the case of a rear door on a truck, movement of the door past a 180° position may cause contact of the door against the bed of the truck. Contact between these structures usually affects damage to at least one and probably both of them.

It is also preferable for the rear door to have an intermediate position between the fully open and fully closed positions to prevent the need to move the door the entire distance of travel to the fully open position in order to enter the vehicle and then to again move the door the entire distance of travel in order to close the door. Additionally, once a passenger has entered and is situated within the vehicle, it is generally difficult for that passenger to then move the door toward and into the closed position from the fully open position, since this operation requires the passenger to reach outwardly and rearwardly of the door opening and then affect an outwardly directed closing force on the door. Furthermore, passengers may utilize the rear door, when in the intermediate position, as a handle or support to facilitate entering and exiting the vehicle, especially when the vehicle is relatively high from the ground.

To solve this problem, previous designs of hinges for this type of door have called for an intermediate position, which prevents the door from moving therepast toward and/or into the fully open position. These hinges however have had a primary disadvantage. Usually only one hinge per door was provided with stopping structure to provide the intermediate position so that the user need not manipulate two latch mechanisms (as would be present if two hinges each having a stopping structure were used) to release the door from the intermediate position. However, since only one of the hinges is provided with stopping structure, upon rapid opening of the door to the intermediate position, or applying a force on the door once in the intermediate position (such as a passenger leaning or steadying themselves on the door, or a wind gust), the door may undergo flexural loading about the hinge with the stopping structure. This may cause warpage of the door and of one or both of the hinges. Once the door and/or hinge(s) are warped, proper operation and/or sealing of the door (against the vehicle body when closed) is seldom achievable.

A previous type of hinge, disclosed in U.S. Pat. No. 4,744,127, includes a door mounting bracket, a body mounting bracket, and an intermediate member pivotally connected to each bracket at respective ends thereof. The hinge of the '127 patent provides to a door mounted thereto 180° of pivotal movement sequentially about two axes. However, the hinge of the '127 patent fails to provide an intermediate position of the door wherein the door is prevented from further pivotal movement past the intermediate position towards the fully open position. As disclosed, the hinge of the '127 patent provides a spring bias of the door in the fully open position. An extension spring is connected between the intermediate member and the door mounting bracket. The spring is arranged to go into an over-center orientation upon achieving the fully open position relative to the pivot axis provided between the door mounting bracket and the intermediate member to thereby bias the intermediate member into the fully open position. As such, the door is predisposed to move into the fully open position and requires, in order to close the door, the passenger to apply sufficient force on the door to overcome the spring bias retaining the door in the open position. Applying sufficient force to overcome this spring bias on the door may prove to be difficult, especially from a position within the vehicle, as described above.

The present invention avoids these limitations by providing a door hinge system for supporting a vehicle door on a vehicle body so that the vehicle door is movable to a fully closed position, a fully opened position, and an intermediate position between the fully open and fully closed positions. The hinge system of the present invention comprises a pair of hinge assemblies. Each of the hinge assemblies comprises a body mounting structure configured to be mounted to the vehicle body, a door mounting structure configured to be mounted to the vehicle door, and a dual pivot swing arm. The swing arms are respectively pivotally connected to the body mounting structures for relative pivotal movement about a first axis and are also respectively pivotally connected to the door mounting structures for relative pivotal movement about a second axis. Each of the hinge assemblies includes a swing arm latch, which is movable between a latched position and a released position. The latches are normally in the latched positions thereof. At least one of the hinge assemblies provide a stop surface, which is positioned such that, when the door and body mounting structures are mounted to the vehicle door and body, respectively, movement of the vehicle door towards the fully open position is limited to pivotal movement about one of the first and second axes by the latches being in the latched positions thereof. The vehicle door then is stopped at the intermediate position by the stop surface so that movement of the latches to the released positions thereof and subsequent pivotal movement of the vehicle door about the other of the first and second axes is required to enable the door to be moved from the intermediate position to the fully open position. The hinge system also includes a single manually operable release member operatively connected to each of the latches. The release member is manually movable to affect movement of each of the latches from the latched positions to the released positions thereof.

DETAILED DESCRIPTION OF THE INVENTION

Figure 1:
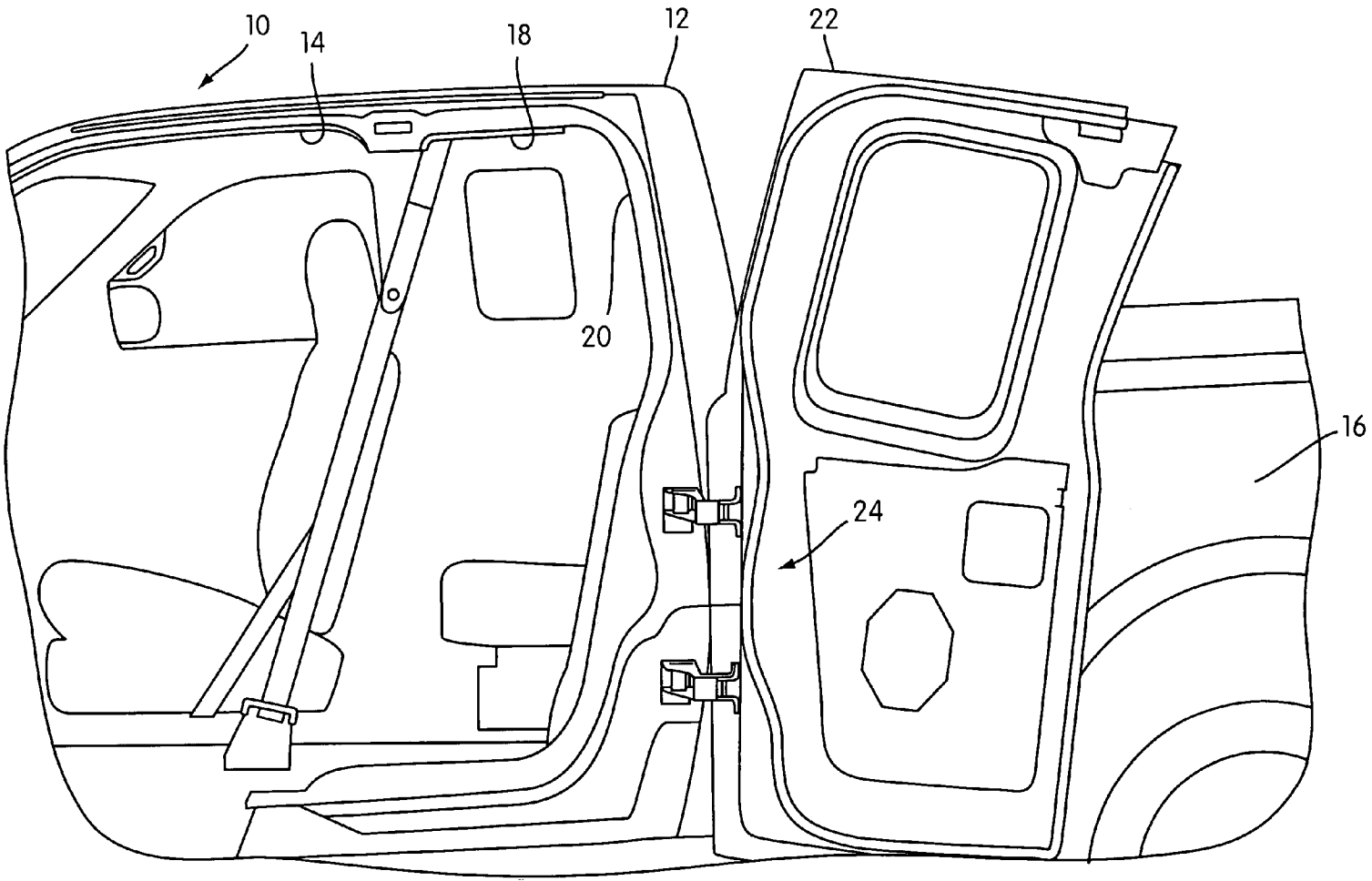
FIG. 1 is a side view of a vehicle with a rear door connected to a body of the vehicle with a door hinge system of the present invention for purpose of illustrating the hinge system environment.

FIG. 1 shows a vehicle 10, of the type commonly referred to as a truck, having a vehicle body 12. The vehicle body 12 provides an operator and passenger compartment, or a cab portion, 14 and a vehicle bed 16. The cab portion 14 of the truck 10 provides an extended cab portion 18, which has a door opening 20 within at least one lateral side thereof. It is contemplated that either side, or both sides, of the extended cab portion 18 may include door openings 20 therein. The truck 10 includes a rearward vehicle door 22 that is pivotally connected to the vehicle body 12 by a door hinge system 24 of the present invention. It is noted that door hinge system(s) 24 of the present invention may be utilized on either side or both sides of the extended cab portion 18 coinciding with door opening(s) 20 and door(s) 22 on either or both sides thereof.

Figure 2:
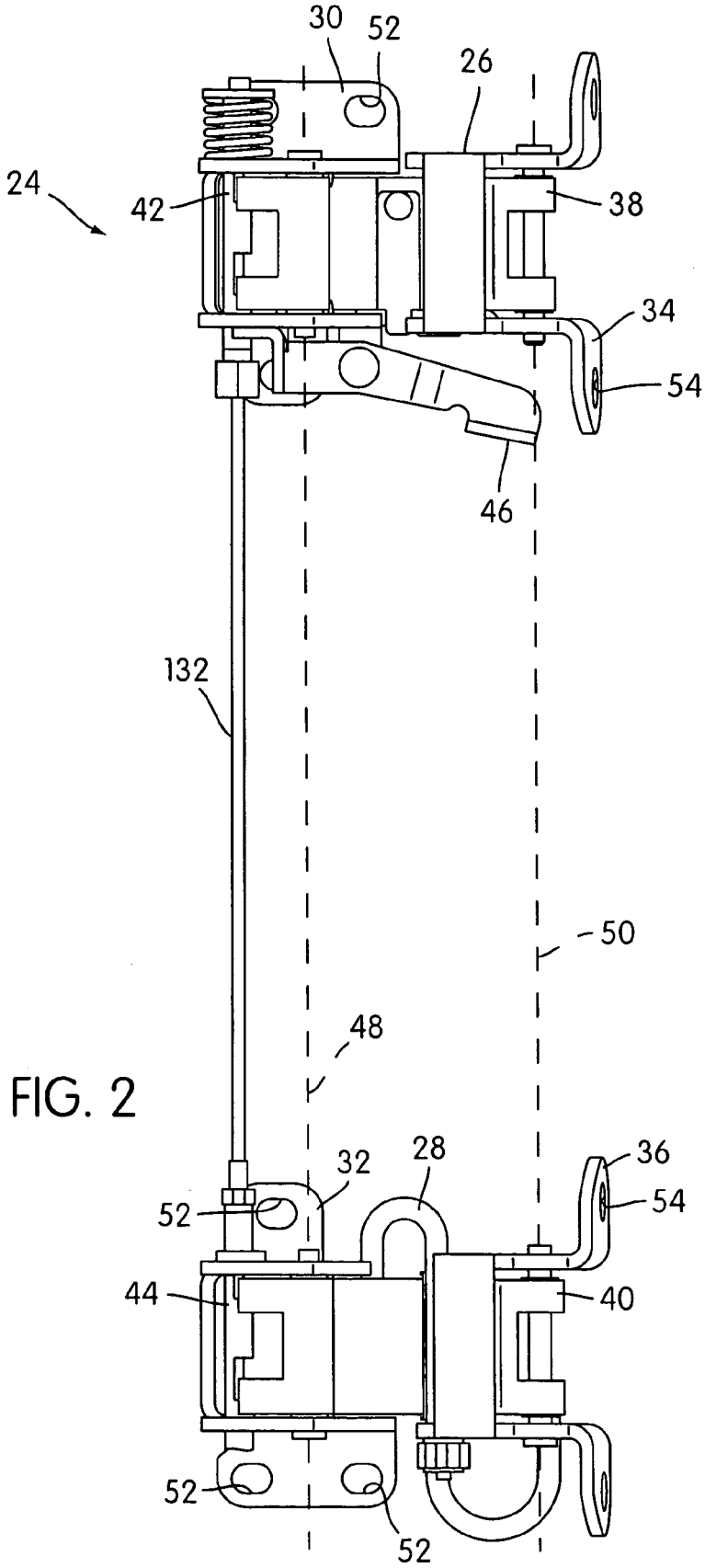
FIG. 2 is a side view of the hinge assemblies of the door hinge system shown in FIG. 1.

As shown in FIG. 2, the door hinge system 24 includes a pair of hinge assemblies 26, 28. Each of the pair of hinge assemblies 26, 28 includes a respective body mounting structure 30, 32 a door mounting structure 34, 36 (it is noted that the a body mounting structure 30, 32 and/or door mounting structures 34, 36 may be substantially similar for both hinge assemblies 26, 28) and a dual pivot swing arm 38, 40. Additionally, each of the hinge assemblies 26, 28 includes a swing arm latch 42, 44. The hinge assembly 26 also includes a single manually operable release member 46.

As shown in FIG. 2, the dual pivot swing arms 38, 40 of the door hinge assemblies 26, 28 are pivotally connected to respective body mounting structures 30, 32 to allow pivotal movement of the swing arms 38, 40 (and therefore the door mounting structures 34, 36 and the vehicle door 22) about a first pivotal axis 48. The swing arms 38, 40 are also pivotally connected to respective door mounting structure 34, 36 to allow pivotal movement of the door mounting structures 34, 36 (and therefore the vehicle door 22) about a second axis 50. As shown, the body mounting structures 30, 32 have openings 52 that cooperate with respective openings (not shown) within the vehicle body 12 to receive and accept associated threaded fasteners (not shown), to rigidly fasten the hinge assemblies 26, 28 to the vehicle body 12. It is also contemplated that the vehicle body 12 may be provided with threaded studs (not shown) to correspond with the openings 52. In this case, the studs extend through the corresponding openings 52 and the body mounting structures 30, 32 are fixed thereto with fasteners, such as nuts. The door mounting structures 34, 36 have openings 54 that cooperate with respective openings (not shown) in the vehicle door 22 to accept and receive associated threaded fasteners (not shown) to rigidly secure the door mounting structures 34, 36 to the vehicle door 22. It is also contemplated that the door 22 may include threaded studs (not shown) in lieu of openings in the door 22. In this case, the studs correspond with and extend through the openings 54 in the door mounting structures 34, 36 to allow the door 22 to be fixed to the door mounting structures 34, 36 with, for example, nuts.

Figure 3A:
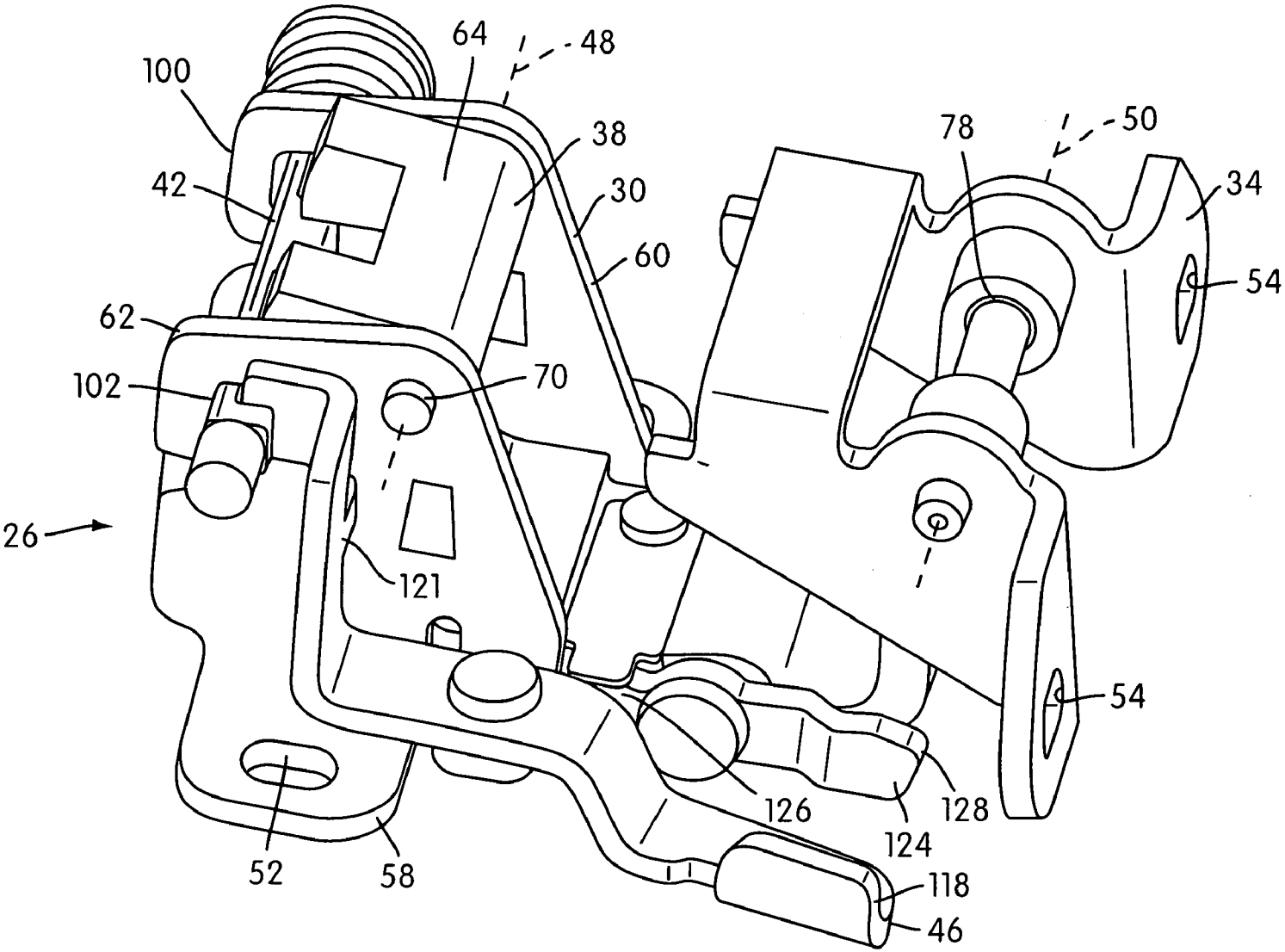
FIG. 3A is a perspective view of the upper hinge assembly of the door hinge system shown in FIG. 2 with a door mounting assembly in a first position thereof corresponding to a closed position of the hinge system.
Figure 3B:
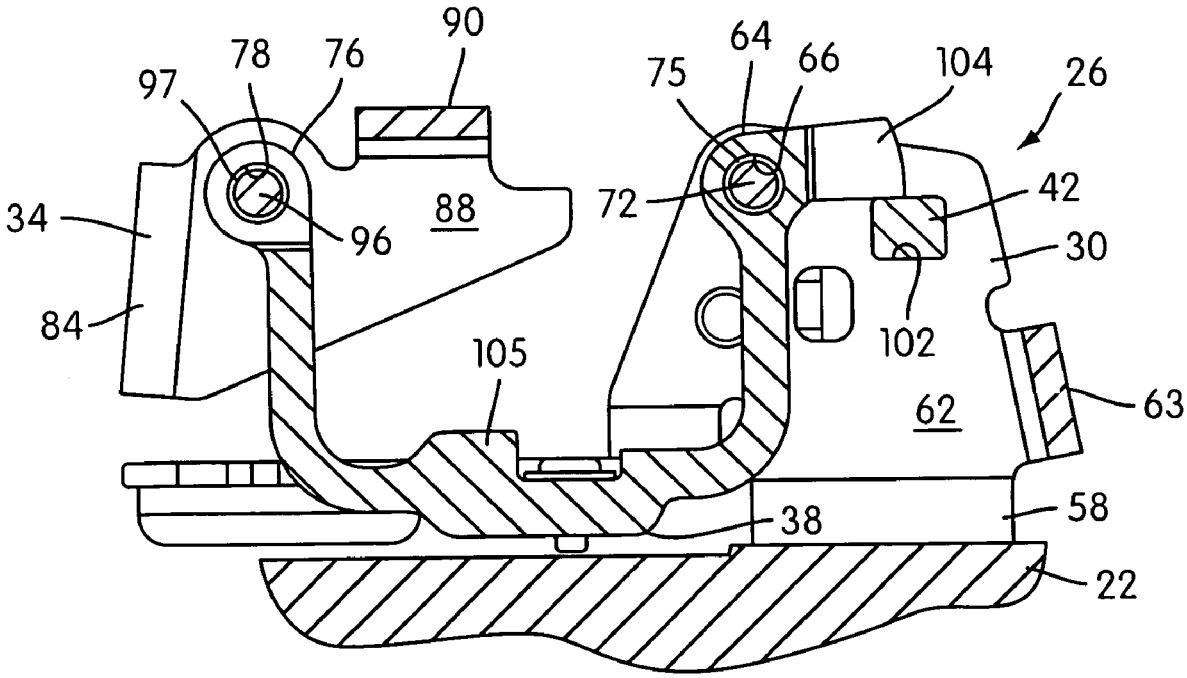
FIG. 3B is a sectional view of the hinge assembly shown in FIG. 3A taken about line 3—3 in FIG. 4.
Figure 4:
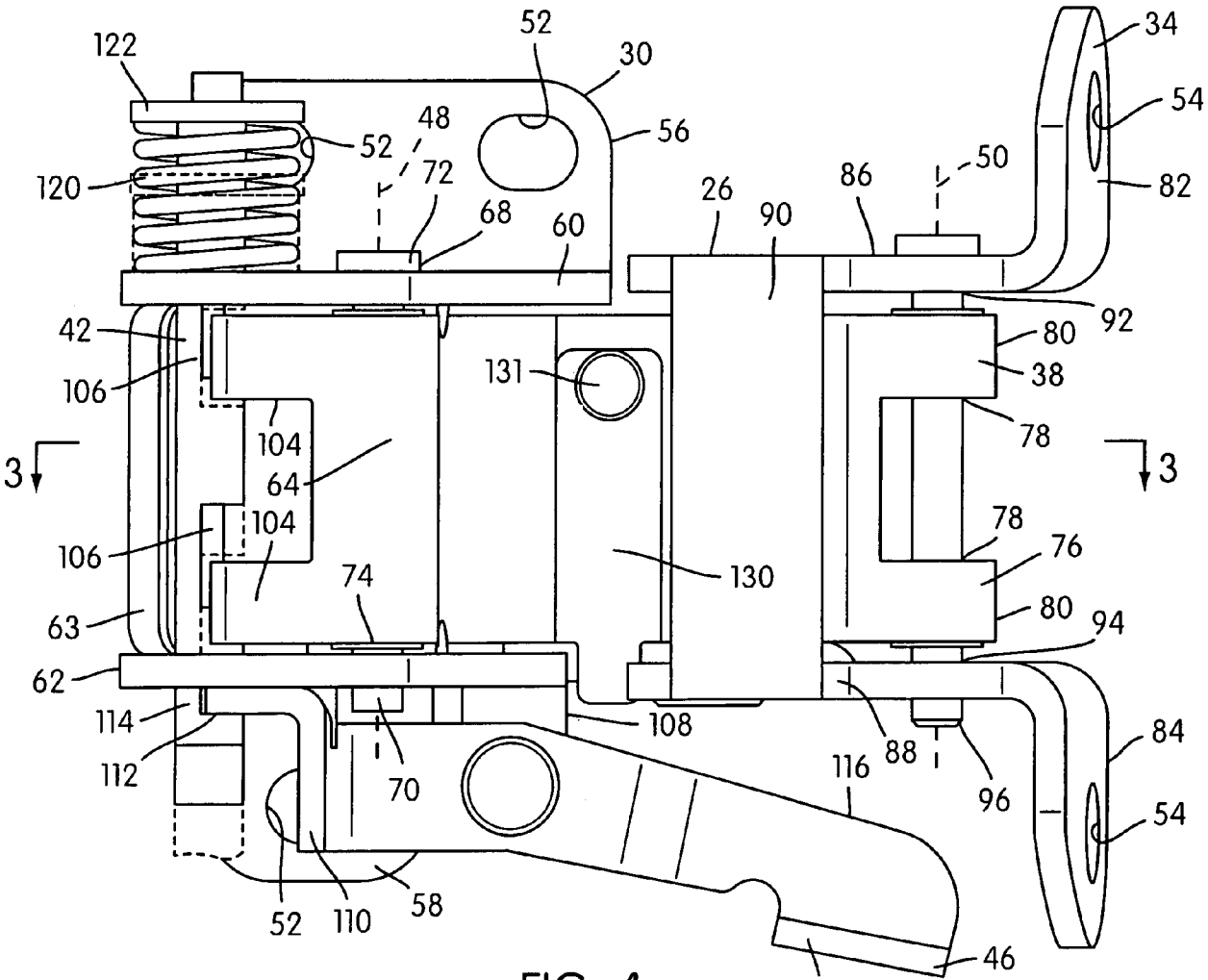
FIG. 4 is a plan view of the hinge assembly shown in FIG. 3A.

FIGS. 3A–5F are directed to the hinge assembly 26. As shown in FIGS. 3A and 4, the body mounting structure 30 includes a pair of laterally extending flange portions 56, 58 within which the openings 52 are formed. A pair of upstanding spaced parallel walls 60, 62 extend from the laterally extending flange portions 56, 58. The spaced parallel walls 60, 62 are interconnected by a straddle portion 63. A first end portion 64 of the swing arm 38 is disposed between the upstanding walls 60, 62. The first end portion 64 includes a pin accepting cylindrical hole 66, which is coaxial with openings 68, 70 within upstanding walls 60, 62. A pin member 72 extends through each opening 68, 70 and the cylindrical hole 66. It is contemplated that the pin member 72 may have a flanged portion 74 on one end and may be mechanically secured on the opposite end such as by swaging or deforming. Of course, it is possible that any other suitable mechanical operation or fasteners may be used to pivotally mount the swing arm 38 to the body mounting structure 30. Shown in FIG. 3B, a bushing element 75 may be disposed within the cylindrical hole 66 between an inner periphery thereof and an outer periphery of the pin member 72 to facilitate pivotal movement of the swing arm about the pin member 72. It may be preferable for the bushing element 75 to be formed of a low friction material. A second end portion 76 of the swing arm 38 also includes a cylindrical hole 78. As shown in FIG. 5B, the cylindrical hole 78 may be formed within a pair of spaced protruding portions 80. Further, the body mounting structure 30 includes a pair of stop structures 81, which extend inwardly from respective wall portions 86, 88.

The door mounting structure 34 provides a pair of laterally extending flange portions 82 and 84, which abut respective surfaces of the vehicle door 22. The door mounting structure 34 further includes a pair of spaced parallel wall portions 86, 88, which are connected by a laterally extending strap member 90 that extends between and interconnects the wall portions 86, 88. The second end portion 76 of the swing arm 38 is disposed between the wall portions 86, 88 of the door mounting structure 34. The wall portions 86, 88 include openings 92, 94 (see FIG. 4) that are coaxial with the cylindrical hole 78. A pin member 96 extends within the cylindrical hole 78hole 78 and the openings 92, 94. As with pin member 72, pin member 96 may include a radially outwardly extending flange portion on one end thereof and may be mechanically secured on another end thereof to secure the pin member 96 within the openings. A bushing element 97 may be disposed within the hole 78 hole 78 between an inner periphery thereof and an outer periphery of the pin member 96 to facilitate pivotal movement of the door mounting structure 34 about the pin member 96. As with the bushing element 75, the bushing element 97 is preferably formed of a low friction material.

Figure 5A:
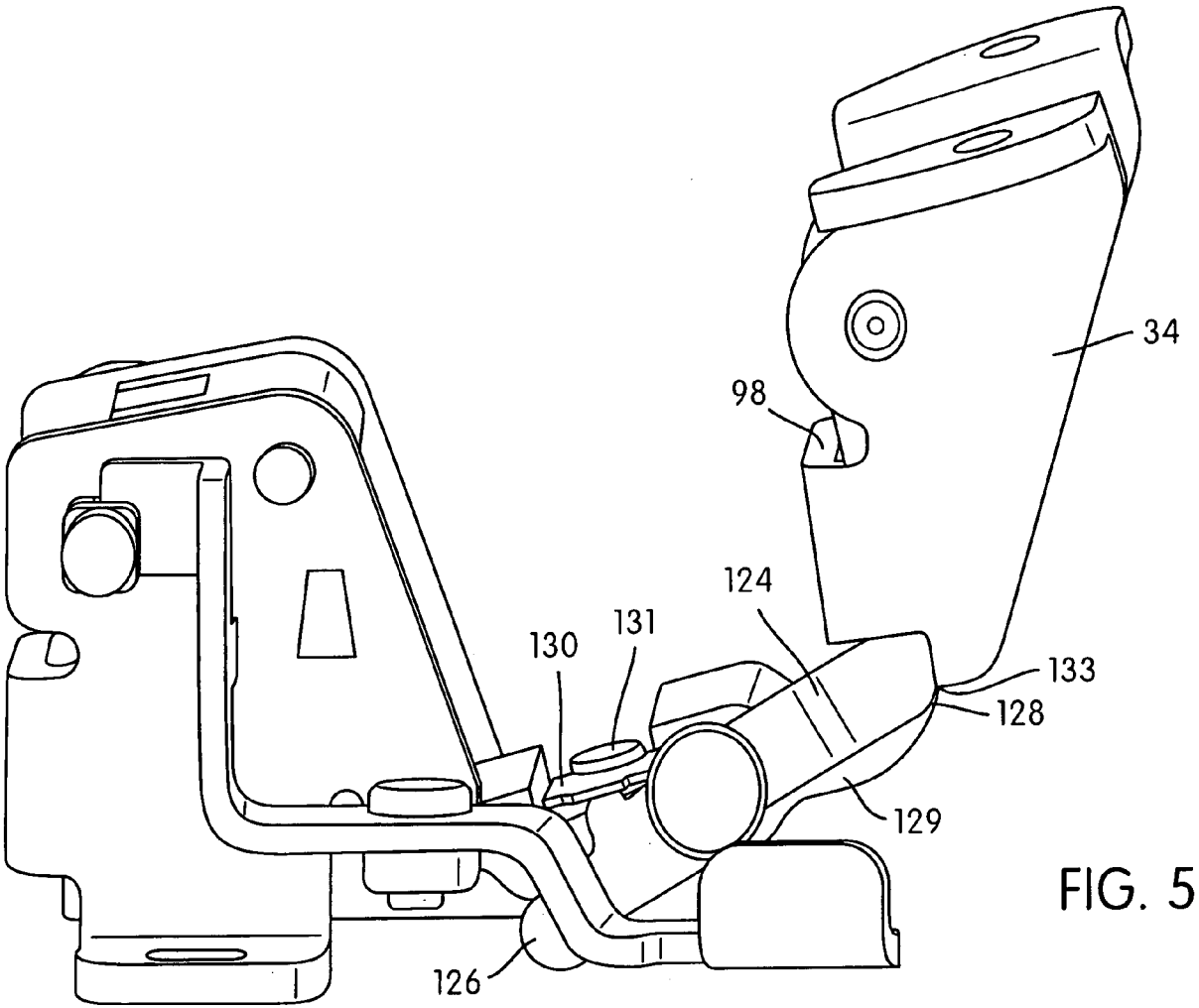
FIG. 5A is a perspective view of the hinge assembly shown in FIG. 3A with the door mounting structure in a second position thereof corresponding to the intermediate position of the door.
Figure 5B:
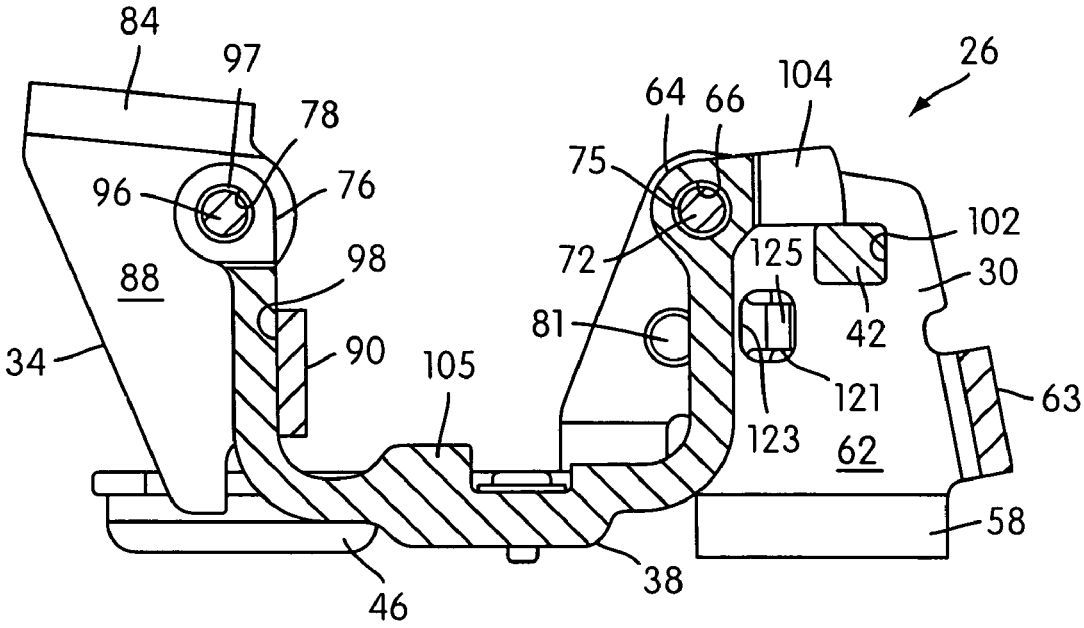
FIG. 5B is a sectional view similar to FIG. 3B with the door mounting structure in the second position thereof.
Figure 5C:
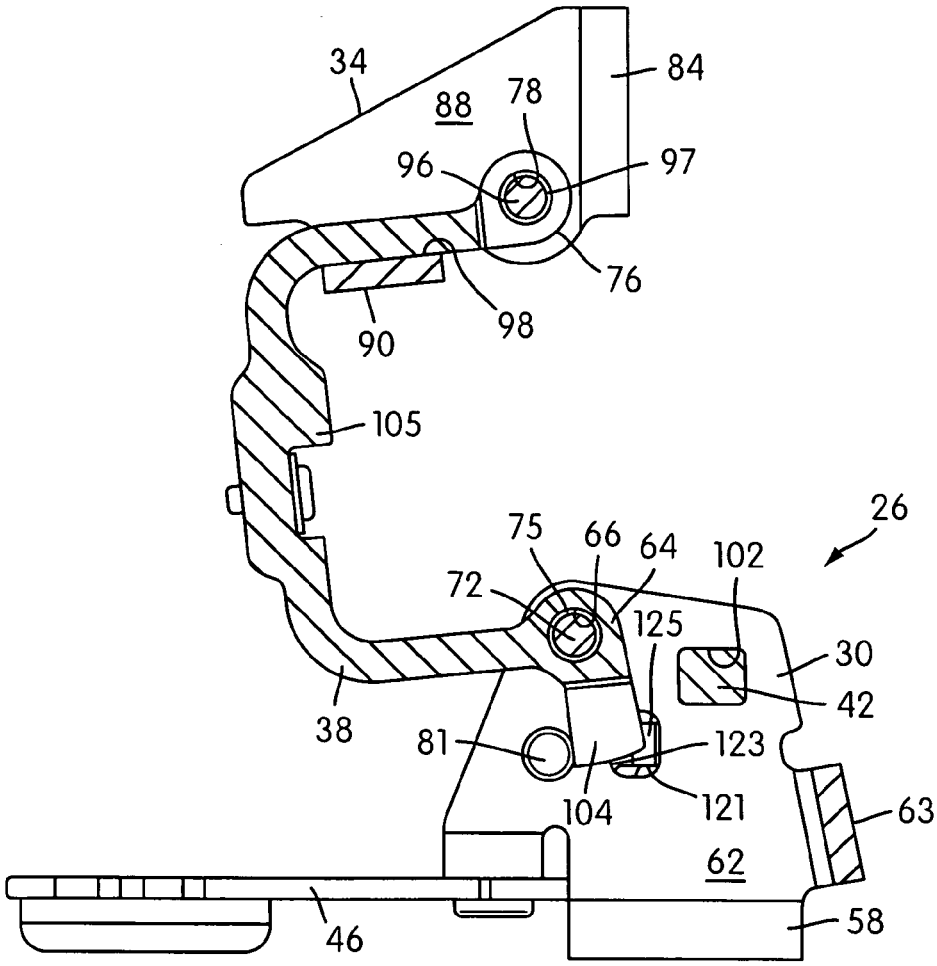
FIG. 5C is a sectional view similar to FIGS. 3B and 5B with a swing arm in the second position thereof.

As described above and shown respectively in FIGS. 3A and 3B, the door mounting structure 34 is pivotal about the second axis 50 relative to the swing arm 38 between a second position and a first position. The first position of the door mounting structure 34 relative to the swing arm 38 is shown in FIGS. 3A and 3B, while the second position is shown in FIGS. 5A and 5B. The swing arm 38 is pivotal about the first axis 48 relative to the body mounting structure 30 between a second and a first position. The first position of the swing arm 38 relative to the body mounting structure 30 is shown in FIGS. 3B and 5B, while the second position is shown in FIG. 5C. As such, movement of the door mounting structure 34 between the first and second positions thereof relative to the swing arm 38, while the swing arm 38 is in the first position thereof relative to the body mounting structure 30, corresponds to movement of the vehicle door 22 between the fully closed and intermediate positions thereof, respectively. Further, movement of the swing arm 38 between the first and second positions thereof relative to the body mounting structure 30, while the door mounting structure 34 is in the second position thereof relative to the swing arm 38, corresponds to movement of the vehicle door 22 between the intermediate and fully open positions thereof. As shown, movement of the door mounting structure 34 relative to the swing arm 38 from the first position to the second position thereof corresponds to about 90° of movement of the vehicle door 22 (e.g., movement of the door 22 between the fully closed and the intermediate positions thereof). Therefore, in the illustrated embodiment, the intermediate position of the vehicle door 22 provides about 90° between the vehicle door 22 and the door opening 20. As further shown, movement of the swing arm 38 relative to the body mounting structure 30 from the first position to the second position thereof corresponds to about 85° of movement of the vehicle door 22 (e.g., movement of the door 22 between the intermediate and fully open positions thereof). Therefore, in the illustrated embodiment, the fully open position of the vehicle door 22 provides about 175° between the vehicle door 22 and the door opening 20. Of course, the fully open position may be provided at any angle relative to the door opening 20.

As shown in FIG. 5B, the door mounting structure 34 is prevented from further pivotal movement past the second position thereof (relative to the swing arm 38) by the engagement of the strap member 90 and the swing arm 38. More specifically, a stop surface 98 of the strap member 90 engages a confronting surface of the swing arm 38. It is noted that a maximum allowed angle for the door mounting structure 34 relative to the swing arm 38 may be altered by manipulating the position of the strap member 90 (i.e., the stop surface 98 thereof) relative to the door mounting structure 34. More specifically, it is contemplated that the maximum allowed angle may be relatively increased by positioning the strap member 90 relatively further outwardly from the wall portions 86, 88 (thereby increasing the pivotal distance the door mounting structure 34 may traverse before stop surface 98 encounters the confronting surface of the swing arm 38) and vice versa for reducing the maximum allowed angle. As such, the pivotal displacement between the vehicle door 22 and the door opening 20 when the door 22 is in the intermediate position thereof may be varied from the embodiment shown.

As shown in FIG. 4, the swing arm latch 42 extends between the upstanding walls 60, 62 of the body mounting structure 30. FIG. 5B shows the rectangular sectional configuration of the latch 42, as well as one of a pair of cooperating rectangular openings 100, 102 within the upstanding walls 60, 62. In this manner, the swing aim latch 42 may be non-rotatably mounted within the openings 100, 102. However, due to the cooperation of the rectangular openings 100, 102 and the latch 42, the latch 42 is capable of slidably moving between a first latched position, shown in FIG. 4, and a second released position, shown schematically in FIG. 4. As further shown, the swing arm latch 42 includes a pair of tangs 104 extending outwardly therefrom.

FIG. 3B shows the swing arm 38 having a generally U-shaped configuration, including the first and second end portions 64, 76 and a central portion 105 therebetween. As described previously, the swing arm 38 is capable of pivotal movement about the pin member 72. Shown in FIG. 3B, the swing arm 38 has the first position (relative to the body mounting structure 30), wherein the central portion is disposed generally adjacent and parallel to the vehicle body 22. While the swing arm 38 is in the first position thereof, the first end portion 64 of the swing arm 38 is in engagement with the latch 42, which retains the swing arm 38 in the first position thereof and substantially prevents pivotal movement of the swing arm 38 about the pin member 72 (i.e., about the first pivotal axis 48). As such, the door mounting structure 34 may be moved between the first and second positions thereof (relative to the swing arm 38) without affecting movement of the swing arm 38 relative to the body mounting structure 30. Consequently, the vehicle door 22 may be moved between the fully closed position thereof and the intermediate position thereof about the second axis 50 only.

Referring to FIG. 4, the latch 42 includes a pair of passageways 106 extending partially therethrough. Upon sliding movement of the latch 42 toward and into the released position thereof, the passageways 106 are correspondingly moved into alignment with respective tangs 104 of the first end portion 64, such that the tangs 104 can pass through the passageways 106. That is, the passageways 106 are spaced to correspond with respective tangs 104 of the first end portion 64, such that the tangs 104 may pass through the passageways 106 without interference. As such, the swing arm 38 is capable of substantially unobstructed pivotal movement about the first axis 48 when the latch 42 is in the released position thereof. Shown in FIG. 5C, with the latch 42 in the released position thereof, the swing arm 38 is substantially free to move between the first position and the second position thereof. In other words, with the latch 42 in the released position thereof, the vehicle door 22 is substantially free to move between the intermediate position thereof and the fully open position thereof.

Shown in FIG. 4, the single manually operable release member 46 is pivotably connected at a central portion thereof to a flange member 108 provided by the body mounting structure 30. A first end portion 110 of the release member 46 includes a latch-engaging portion 112 that extends toward the latch 42 and engages a slot 114 within the latch 42. A second end portion 116 of the release member 46 includes a manually engagable portion 118. The latch 42 is resiliently urged toward and into the latched position by a spring member 120. The pivotal nature of the release member 46 allows the transfer of manually applied force on the manually engagable portion 118 to the latch-engaging portion 112. A reactionary force is created, which acts on the latch 42 against the bias of the spring member 120, thus facilitating manual movement of the latch 42 toward and into the released position.

As shown in FIG. 3A, the first end portion 110 of the release member 46 also includes a tang portion 121 extending therefrom. The tang portion 121 is turned inwardly from the first end portion 110 of the release member 46 toward the upstanding wall 62 of the body mounting structure 30. Referring to FIGS. 5A, 5B and 5C, to accommodate the tang portion 121, the upstanding wall 62 has a receiving opening 123 extending transversely therethrough aligned with the tang portion 121. As such, the tang portion 121 passes within the receiving opening 123 to be substantially disposed between the upstanding walls 60, 62 of the body mounting structure 30. It is noted that the tang portion 121 is moveable with the latch-engaging portion 112, affected by manual movement of the release member 46.

The tang portion 121 includes a sliding surface 125 on an outermost end thereof relative to the release member 46. As described above, the latch 42 is moved into the released position thereof prior to movement of the swing arm 38 about the first axis 48 toward the second position thereof. Simultaneously, the tang portion 121 is moved into a position substantially outward of the body mounting structure 30. Before tangs 104 on the first end portion 64 of the swing arm 38 pass through the passageways on latch 42, one of the protrusions 109 of the first end portion 64 moves into abutting relation to the sliding surface 125 of the tang portion 121. When the first end portion 64 clears the latch 42, the sliding surface 125 is brought into engagement with the protrusion 109 by the bias of the spring 120. The cooperation between the tang portion 121 (i.e., the sliding surface 125) and the protrusion 109, retains the latch 42 in the released position thereof once the first end portion 64 loses contact with the latch 42. The sliding surface 125 remains in contact with the protrusion 109 as the swing arm 38 moves toward and into the fully open position (see FIG. 5C) and back to a position just prior to the intermediate position wherein the first end portion 64 re-engages the latch 42. In this manner, the door 22 may be moved from the fully open position back to the intermediate position without additional manual manipulation of the release member 46.

As shown in FIG. 4, the latch 42 includes a radially outwardly extending flange structure 122. The spring member 120 is disposed between an outer surface of the upstanding wall 60 and a confronting surface of the flange structure 122 to thereby resiliently urge the latch 42 into the latched position, as described above. The release member 46 allows the user to slidably move the latch 42 against the spring bias of the spring member 120 into the released position wherein the tangs 104 may pass through the passageways 106.

Shown in FIGS. 3A and 5A, the hinge assembly 26 further includes a check member 124, which is pivotably mounted at a central portion thereof to the swing arm 38. The check member 124 includes a first end portion 126 and an opposite second end portion 128 and is mounted to the swing arm 38 via fastener 129 for pivotal movement about a laterally oriented pivot axis (laterally, relative to the swing arm 38). FIG. 4 shows a tab spring 130, which is mounted to the swing arm 38 by a fastener 131 to engage the check member 124 adjacent the first end portion 126 to thereby bias the first end portion 126 away from the tab spring 130. FIG. 3A shows the check member 124 in a first position relative to the swing arm 38. As shown, the check member 124 is disposed in generally adjacent and parallel relation to the central portion 105 of the swing arm 38. In the first position thereof (which corresponds to the fully closed and intermediate positions of the door 22), the first end portion 126 of the check member 124 is in abutting engagement with the vehicle body 12, thereby retaining the check member 124 in the first position thereof (i.e., the engagement between the first end portion 126 and the vehicle body 12 prevents pivotal movement of the check member 124). As such, the door mounting structure 34 can move between the first and second positions thereof without interference from the check member 124. As shown in FIG. 5A, during movement of the door 22 from the intermediate position thereof to the fully open position thereof, once the swing arm 38 begins to pivotally move from the first position thereof towards the second position thereof about the first axis 48, the first end portion 126 is disengaged from the vehicle body 12 and the tab spring 130 resiliently urges the first end portion 126 relatively towards the vehicle body 12. As such, the check member 124 pivots towards a second position thereof, as the swing arm 38 continues to pivot towards the second position thereof. In other words, as the swing arm 38 pivots away from the vehicle body 12, the check member 124 moves towards the second position thereof.

FIG. 5A shows the door mounting structure 34 in the second position thereof and the check member 124 in the second position thereof. The door mounting structure 34 includes a notched portion 133, which is engaged by the second end portion 128 of the check member 124. With the check member 124 in the second position thereof such that the second end portion 128 is in engagement with the notched portion 133, the door mounting structure 34 is substantially prevented from pivotal movement from the second position thereof. It is noted that the check member 124 is retained in the check position thereof by the spring 130 for positions of the door 22 greater than the door position in which the check position is achieved. In other words, generally, the door mounting structure 34 is prevented from pivotal movement toward the closed position about the second axis 50 for positions of the door 22 substantially past the intermediate position.

As previously described, the body mounting structure 30 has the pair of stop structures 81 extending inwardly from respective wall portions 60, 62. It is contemplated that the stop structures may be in the form of pin elements or fasteners, which are situated within respective openings (not shown) within the wall portions 60, 62. Upon reaching the fully open position, corresponding portions of the swing arm 38 engage the associated stop structures 81, thereby rigidly preventing further pivotal movement of the swing arm 38 and door mounting structure 34 (i.e., the vehicle door 22) past the fully open position. It is contemplated that to ensure sufficient clearance between the vehicle bed 16 and the door 22, it may be preferable for the stop structures 81 to be configured and positioned on the body mounting structure 30 relative to the swing arm 38 such that a maximum allowed angle between the door 22 and the door opening 20 is about 175°. It is, of course, possible to position the stop structures 81 on the body mounting structure 30 such that the fully open position occurs at an angle other than 175°. However, it may be preferable, to prevent contact between the vehicle bed 16 and the door 22 and to provide adequate access to the door opening 20, to position the stop structures 81 such that the fully open position occurs at between 150° and 180°.

Figure 5D:
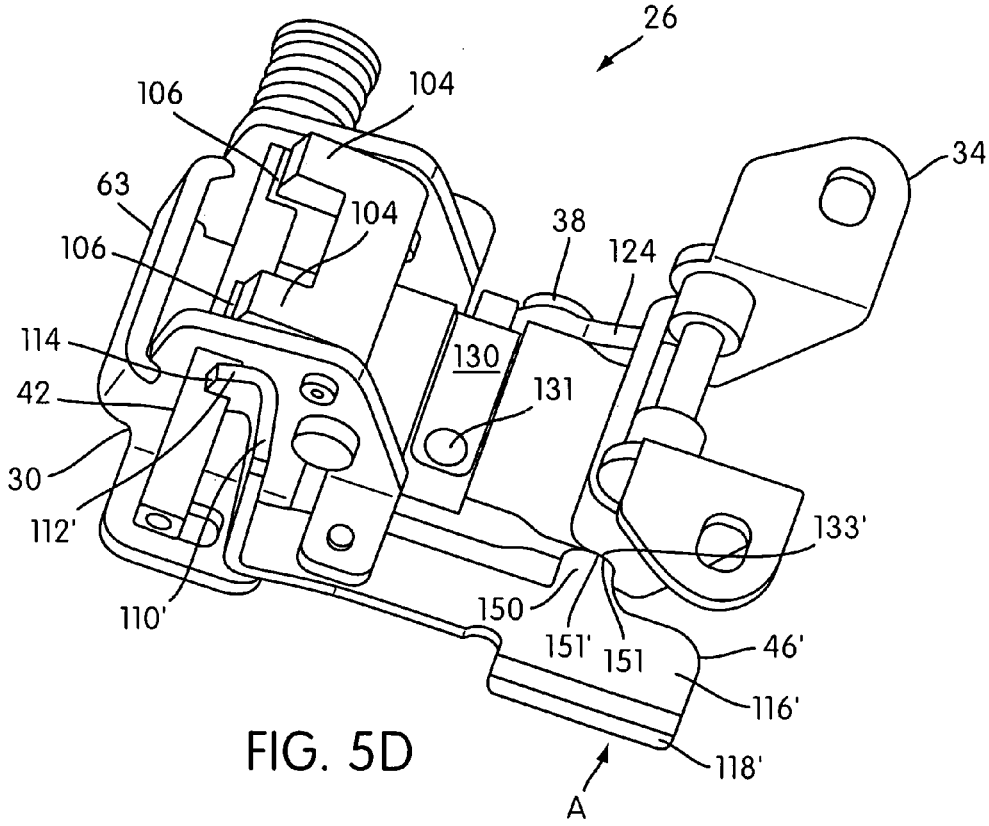
FIG. 5D is a perspective view of an alternate embodiment of the hinge assembly shown in FIG. 3A.
Figure 5E:
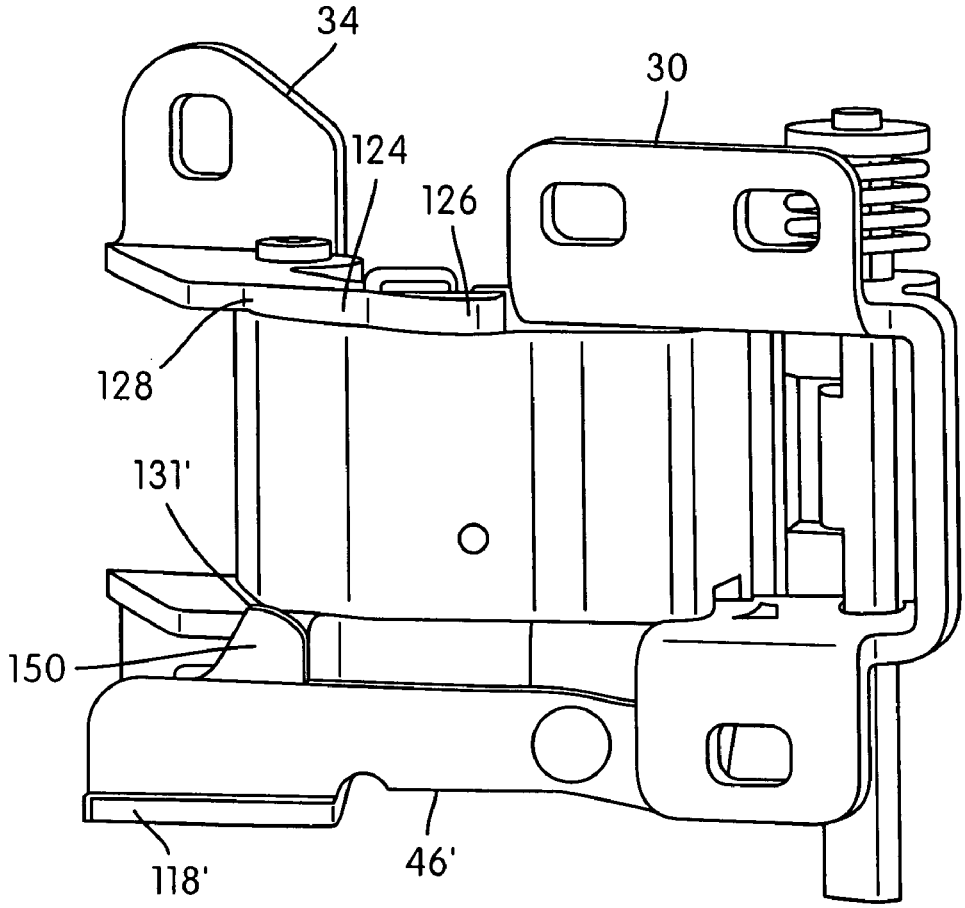
FIG. 5E is another perspective view of the hinge assembly shown in FIG. 5D.
Figure 5F:
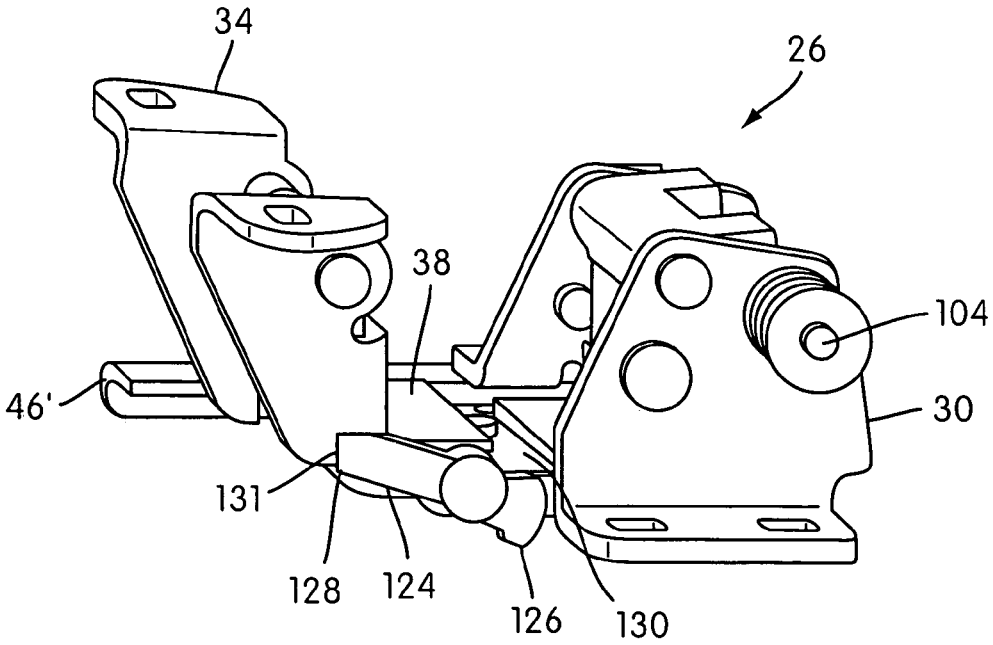
FIG. 5F is yet another perspective view of the hinge assembly shown in FIGS. 5D and 5E.

FIG. 5D shows another contemplated embodiment of the hinge assembly 26. As the embodiment of the hinge assembly 26 illustrated in FIGS. 2–5C and the embodiment of the hinge assembly 26 illustrated in FIGS. 5D–5F are substantially similar, similar components of each embodiment are identified with similar reference numbers. As shown in FIG. 5D, the manually operable release member 46' provides a projecting portion 150 extending outwardly from the second end 116'. The projecting portion 150 includes a ramped, confronting surface 151 on an edge thereof. As the door mounting structure 34 rotates from the second position thereof toward the first position thereof, an abutting surface 151' of the door mounting structure 34, provided by the notched portion 133', engages the ramped, confronting surface 151 to affect outward movement of the second end 116' of the release member 46'. Specifically, abutting surface 151' cams confronting surface 151 to affect this outward movement of the release member's second end 116. This outward movement of the second end 116' serves to move first end portion 110' of the release member 46', which thereby ensures the latch 42 is in its latched position. This feature is advantageous because it ensures that the latch 42 is moved to its latched position in the event the sponge 120 fails to return the latch 42.

As shown in FIG. 5F, the check member 124 may be connected to the swing arm 38 opposite the release member 46'. Operation of the release member 46' is as described above with reference to release member 46.

Figure 6:
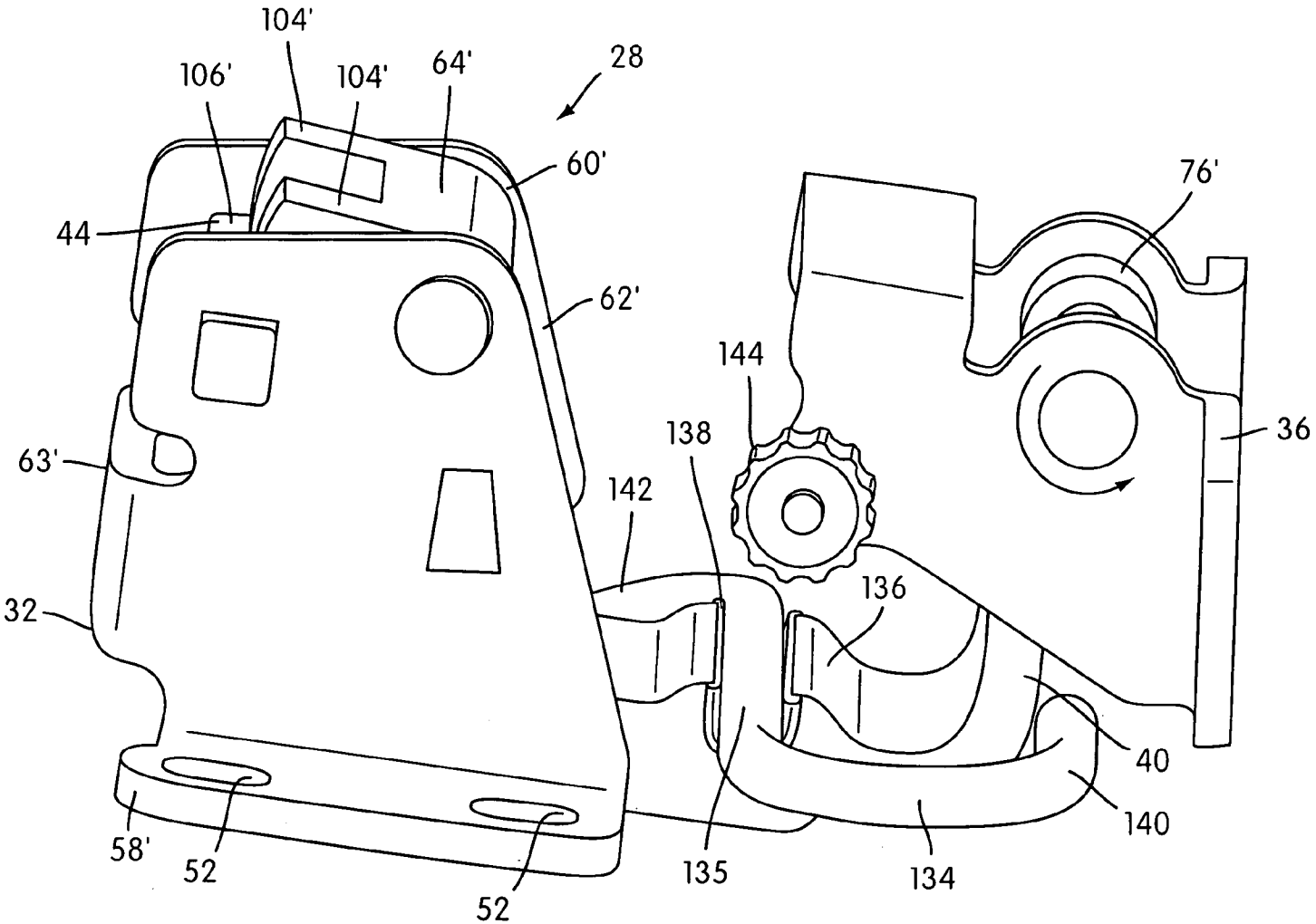
FIG. 6 is a perspective view of the lower hinge assembly shown in FIG. 2 with the door mounting structure in the first position thereof.
Figure 7:
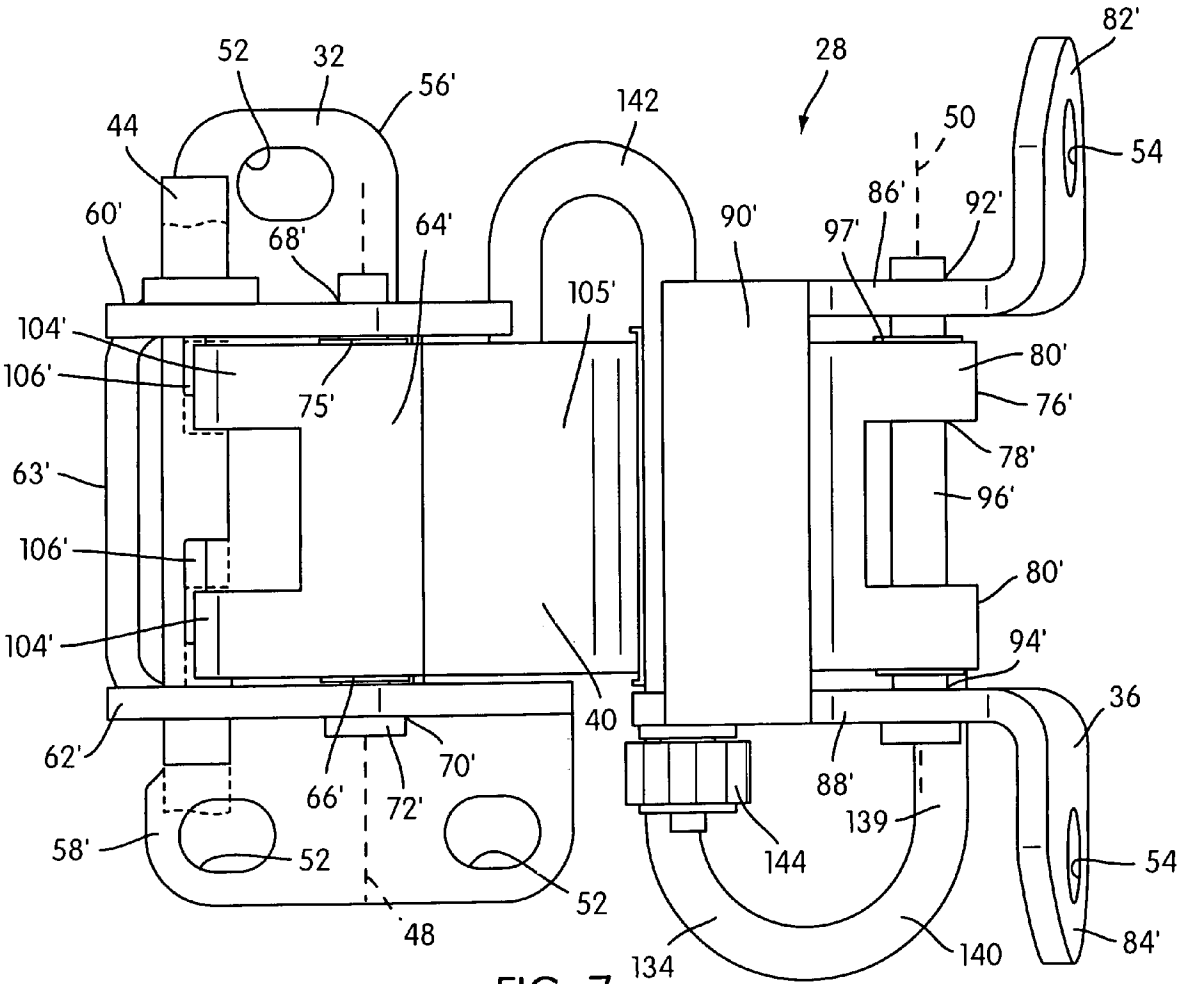
FIG. 7 is a plan view of the hinge assembly shown in FIG. 6.

FIGS. 2, 6–8 are directed to the hinge assembly 28. As shown in FIGS. 6 and 7, the body mounting structure 32' includes a pair of laterally extending flange portions 56', 58' within which the openings 52 are formed. A pair of upstanding spaced parallel walls 60', 62' extend from the laterally extending flange portions 56', 58'. The spaced parallel walls 60', 62' are interconnected by a straddle portion63'. A first end 64' of the swing arm 40 is disposed between the upstanding walls 60', 62'. The first end 64' includes a pin accepting cylindrical hole 66', which is coaxial with openings 68', 70' within upstanding walls 60', 62'. A pin member 72' extends through each opening 68', 70' and the cylindrical hole 66. Similarly to hinge assembly 26, a bushing element 75' may be disposed within the cylindrical hole 66' between the inner periphery thereof and an outer periphery of the pin member 72' to facilitate pivotal movement of the swing arm 40 about the pin member 72'. It is contemplated that the bushing element 75' may be formed of low friction material. A second end 76' of the swing arm 40 also includes a cylindrical hole 78'. As shown in FIG. 7, the cylindrical hole 78' may be formed within a pair of spaced protruding portions 80'. Further, the body mounting structure 32 includes a pair of stop structures 80' (see FIG. 10). Each stop structure 80' extends inwardly from respective upstanding walls 60', 62'.

The door mounting structure 36 provides a pair of laterally extending flange portions 82', 84', which abut respective surfaces of the vehicle door 22. The door mounting structure 36 further includes a pair of spaced parallel wall portions 86', 88', which are connected by a laterally extending strap member 90' that extends between and interconnects the wall portions 86', 88'. The second end 76' of the swing arm 40 is disposed between the wall portions 86', 88' of the door mounting structure 36. The wall portions 86', 88' include openings 92', 94' that are coaxial with the cylindrical hole 78'. A pin member 96' extends within the cylindrical hole 78' and the openings 92', 94'. A bushing element 97' may be disposed within the cylindrical hole 78' between an inner periphery thereof and an outer periphery of the pin member 72' to facilitate pivotal movement of the door mounting structure 36 about the pin member 96'.

Figure 8:
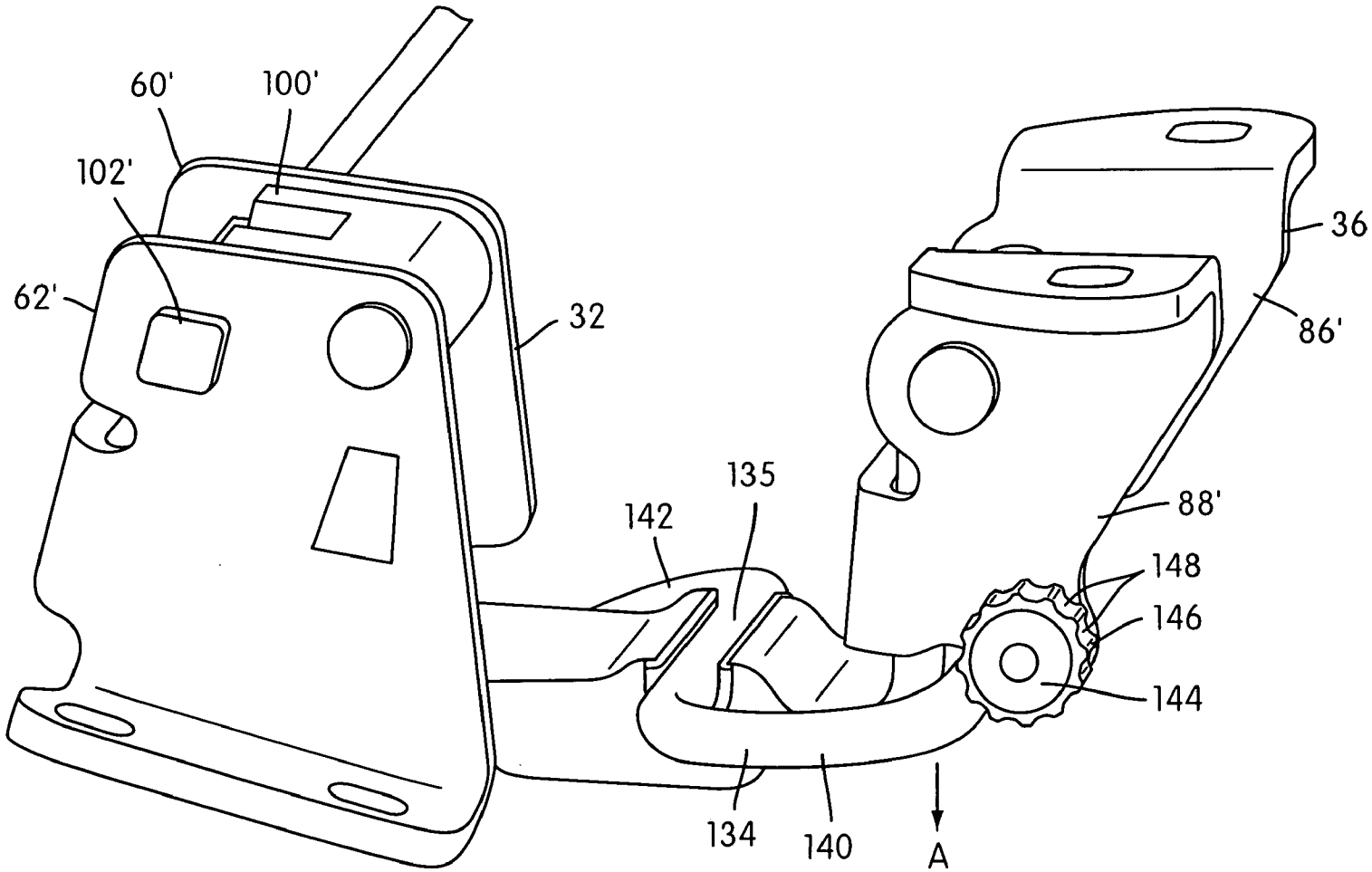
FIG. 8 is another perspective view of the hinge assembly shown in FIG. 6 with the door mounting structure in the second position thereof.

As described above and shown respectively in FIGS. 6 and 8, the door mounting structure 36 is pivotal about the second axis 50 relative to the swing arm 40 between a first position and a second position. The first position of the door mounting structure 36 relative to the swing arm 40 is shown in FIGS. 6 and 7, while the second position is shown in FIG. 8. The swing arm 40 is pivotal about the first axis 48 relative to the body mounting structure 32 between a first and a second position. The first position of the swing arm 40 relative to the body mounting structure 32 is shown in FIGS. 6 and 8. Movement of the door mounting structure 36 between the first and second positions thereof relative to the swing arm 40, while the swing arm 40 is in the first position thereof relative to the body mounting structure 32 corresponds to movement of the vehicle door 22 between the fully closed and intermediate positions thereof, respectively. Further, movement of the swing arm 40 between the first and second positions thereof relative to the body mounting structure 32, while the door mounting structure 36 is in the second position thereof relative to the swing arm 40, corresponds to movement of the vehicle door 22 between the intermediate and fully open positions thereof. As shown, movement of the door mounting structure 36 relative to the swing arm 40 from the first position to the second position thereof corresponds to about 90° of movement of the vehicle door 22. Therefore, in the illustrated embodiment, the intermediate position of the vehicle door 22 provides about 90° between the vehicle door 22 and the door opening 20. As further shown, movement of the swing arm 40 relative to the body mounting structure 32 from the first position to the second position thereof corresponds to about 85° of movement of the vehicle door 22. Therefore, in the illustrated embodiment, the fully open position of the vehicle door 22 provides about 175° between the vehicle door 22 and the door opening 20.

As shown in FIG. 8, the door mounting structure 36 is prevented from further pivotal movement past the second position thereof (relative to the swing arm 40) by the engagement of the strap member 90' and the swing arm 40. More specifically, a stop surface (not shown) of the strap member 90' engages a confronting surface of the swing arm 40. It is noted that a maximum allowed angle for the door mounting structure 36 relative to the swing arm 40 may be altered by manipulating the position of the strap member 90' (i.e., the stop surface 250 thereof) relative to the door mounting structure 36. More specifically, it is contemplated that the maximum allowed angle may be relatively increased by positioning the strap member 90' relatively further outwardly from the wall portions 86', 88' (thereby increasing the pivotal distance the door mounting structure 36 may traverse before the confronting surface of the swing arm 40 encounters the stop surface) and vice versa for reducing the maximum allowed angle. As such, the pivotal displacement between the vehicle door 22 and the door opening 20 when the door 22 is in the intermediate position thereof may be varied from the embodiment shown.

As shown in FIG. 7, the swing arm latch 44 extends between the upstanding walls 60', 62' of the body mounting structure 32. FIG. 8 shows the rectangular sectional configuration of the latch 44, as well as one of a pair of cooperating rectangular openings 100', 102' within respective upstanding walls 60', 62'. In this manner, the swing arm latch 44 may be non-rotatably mounted within the openings 100', 102'. However, due to the cooperation of the rectangular openings 100', 102' and the latch 44, the latch 44 is capable of slidably moving between a first latched position, shown in FIG. 7, and a second released position, shown schematically in FIG. 7. As further shown, the swing arm latch 44 includes a pair of tangs 104' extending outwardly therefrom. As shown, a respective pair of spaced passageways 106 are formed within the latch 44. Referring back to FIG. 2, the swing arm latches 42, 44 are interconnected by a connecting rod 132 so that manipulation of both the latches 42, 44 is accomplished simultaneously via the release member 46, as described above.

Similarly with swing arm 38, the swing arm 40 has a generally U-shaped configuration including the first and second end portions 64', 76' and a central portion 105'. As described above, the swing arm 40 is capable of pivotal movement about the pin member 72'. Shown in FIG. 6, the swing arm 40 has the first position, wherein the central portion 105' is disposed generally adjacent and parallel to the vehicle body 22. While the swing arm 40 is in the first position thereof, the first end 64' of the swing arm 40 is in engagement with the latch 44' (e.g., at least one of the tangs 104' are in contact with the latch 44), which retains the swing arm 40 in the first position thereof and substantially prevents pivotal movement of the swing arm 40 about the pin member 72' (i.e., about the first pivotal axis 48). As such, the vehicle door 22 may be moved between the fully closed position thereof and the intermediate position thereof without affecting pivotal movement of the swing arm 40 about the first axis 48.

Upon sliding movement of the latch 44 toward and into the released position thereof, the passageways 106' are correspondingly moved into alignment with the tangs 104' of the first end 64', such that the tangs 104' are passable through respective passageways 106'. As such, the swing arm 40 is capable of substantially unobstructed pivotal movement about the first axis 48 when the latch 44 is in the released position thereof.

Hinge assembly 28 includes a check spring 134 that is connectable to the swing arm 40. As shown in FIG. 6, swing arm 40 includes a receiving portion 136 within which a central portion 135 of the check spring 134 is mounted. An elongated bushing element 138, with a U-shaped sectional configuration, is disposed within the receiving portion 136 between the peripheries of the receiving portion 136 and the central portion 135.

As shown in FIGS. 6 and 7, the check spring 134 is substantially S-shaped; forming free end portion 140, a fixed end portion 142, and the central portion 135. The central portion 105' of the swing arm 40 includes a spring-receiving recess therein, within which the fixed end portion 142 is partially disposed to thereby fixedly secure the check spring 134 to the swing arm 40. As shown in FIG. 8, the free end portion 140 is engagable with a checking surface 144 of the door mounting member 36.

The door mounting structure 36 includes a spring engaging member 146. The spring engaging member 146 provides the checking surface 144 on an annular radially outwardly facing surface thereof. Shown in FIG. 8, the checking surface 144 defines an annularly spaced series of detents 148, which are engagable with an outer periphery of the check spring 134 as the door mounting structure 36 pivotally moves toward and into the second position thereof. As the door mounting structure 36 moves into the second position shown in FIG. 8, the free end portion 140 of the check spring 134 is engaged with a leading edge portion of the checking surface 144. Due to the circular configuration of the spring engaging member 146 (and thereby the arcuate nature of the checking surface 144) the free end portion 140 is resiliently deflected by a camming action of the spring engaging member 146 upon continued movement of the door mounting structure 36 toward the second position thereof. As the spring engaging member 146 traverses an outer periphery of the free end portion 140 (i.e., as the door mounting structure 36 moves into the second position thereof), a trailing edge of the checking surface 144 allows the free end portion 140 to resiliently move toward an unbiased position (i.e., to partially return to the unbiased position) thereof. As such, with the door mounting structure 36 in the second position thereof, the free end portion 140 imparts a spring force on the trailing edge portion of the checking surface 144. Therefore, in order for the door mounting structure 36 to be moved out of the second position thereof (e.g., in order for the vehicle door 22 to be moved out of the intermediate position thereof) a force must be affected on the door mounting structure 36 (e.g., the vehicle door 22) toward the first position thereof with a magnitude sufficient to overcome the spring force of the check spring 134. As such, the vehicle door 22 is biased from closing from the intermediate position when acted upon by external forces (e.g., wind or gravity—such as when the vehicle is inclined). It is noted that the check spring 134 and engaging member 146, as shown, are configured to necessitate a manually-applied force of substantial magnitude directed toward the closed position of the door 22 in order to overcome the force produced by the check spring 134. However, it is noted that there is also an inherent opening force that must be applied to the door 22 to overcome the force of the check spring 134 to open the door 22 into the intermediate position thereof.

As previously described, the body mounting structure 32 has the pair of stop structures 81' extending inwardly from respective upstanding walls 60', 62'. It is contemplated that the stop structures 81' may be in the form of pin elements or fasteners, which are situated within respective openings (not shown) within the wall portions 60', 62'. Upon reaching the fully open position, corresponding portions of the swing arm 40 engage the associated stop structures 81', thereby rigidly preventing further pivotal movement of the swing arm 40 and door mounting structure 36 (i.e., the vehicle door 22) past the fully open position. It is contemplated that to ensure sufficient clearance between the vehicle bed 16 (may also be referred to as the vehicle box) and the door 22, it may be preferable for the stop structures 81' to be configured and positioned on the body mounting structure 32 relative to the swing arm 40 such that a maximum allowed angle between the door 22 and the door opening 20 is about 175°. It is, of course, possible to position the stop structures 81' on the body mounting structure 32 such that the fully open position occurs at an angle other than 175°. However, it may be preferable, to prevent contact between the vehicle bed 16 and the door 22 and to provide adequate access to the door opening 20, to position the stop structures 81' such that the fully open position occurs between 150° and 180°.

Figure 9:
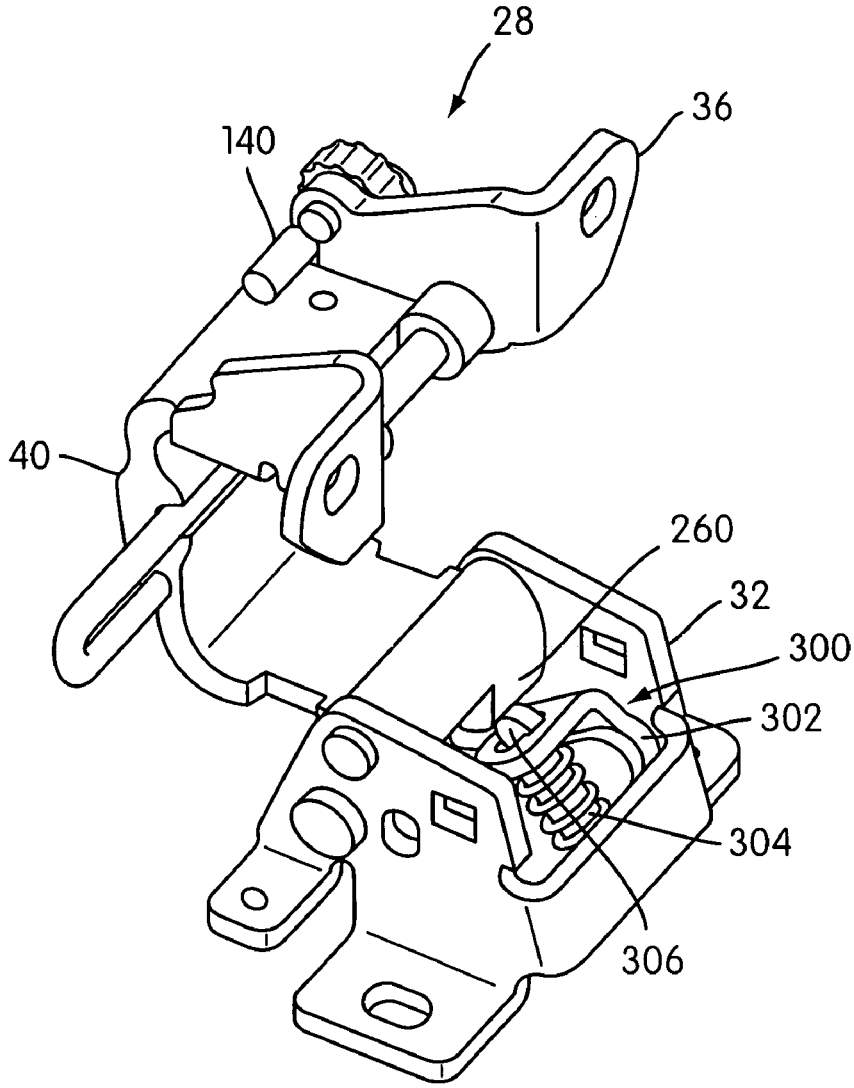
FIG. 9 is a perspective view of the hinge assembly shown in FIG. 7 with a checking device and the swing arm in the second position thereof.
Figure 10:
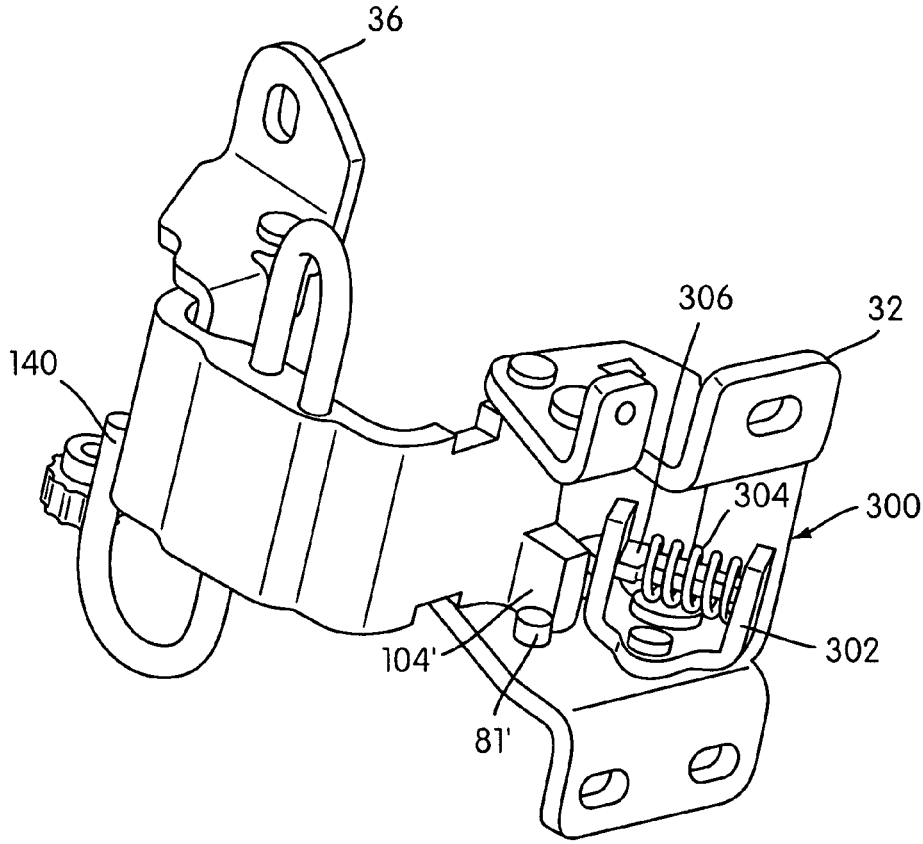
FIG. 10 is another perspective view of the hinge assembly shown in FIG. 9.

Shown in FIGS. 9 and 10, the hinge assembly 28 may include a checking device 300. The checking device 300 resiliently retains the swing arm 40 in the second position thereof relative to the body mounting structure 32. As such, the vehicle door 22 is resiliently retained in the fully open position thereof.

Figure 11:
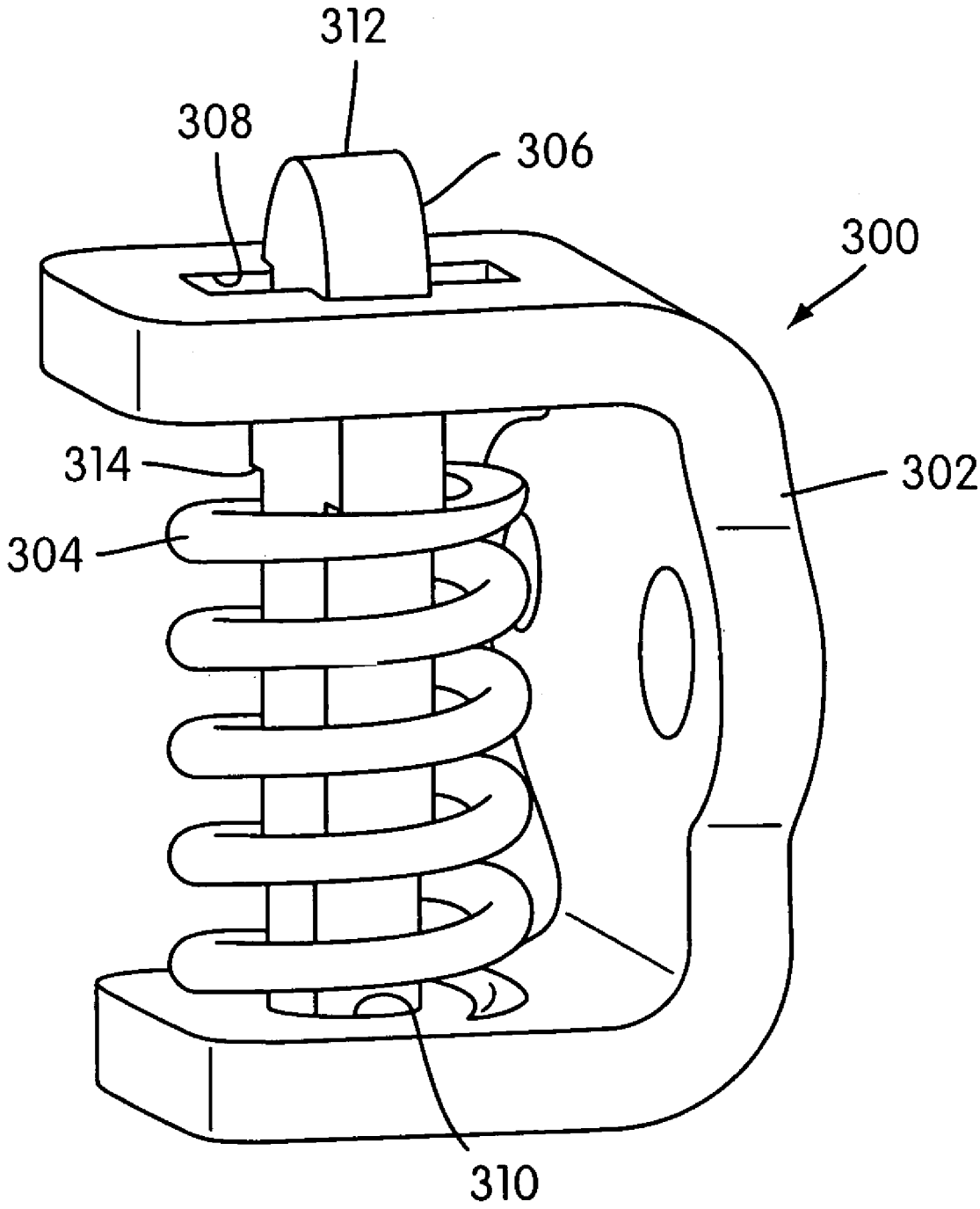
FIG. 11 is a detailed perspective view of the checking device shown in FIGS. 9 and 10.

Shown in greater detail in FIG. 11, the checking device 300 includes a mounting bracket 302 and a biasing element 304. The biasing element 304 is illustrated as a compression spring in FIG. 11. The checking device 300 further includes a stop member 306. As shown, the mounting bracket 302 is generally C-shaped with stop member receiving openings 308, 310 in upper and lower portions thereof. The stop member 306 may be positioned to extend within the openings 308, 310, such that a contacting tip portion 312 extends outwardly from the mounting bracket 302, while a guiding portion is disposed within the opening 310. The biasing element 304 is situated within the mounting bracket 302 with the stop member 306 extending through an inner opening thereof. One end of the biasing element 304 is engaged with a corresponding engaging portion 314 of the stop member 306, while an opposite end is engaged with the lower portion of the mounting bracket 302. As such, the biasing element 304 resiliently biases the stop member 306 relative to the mounting bracket 302 such that the tip portion 312 is resiliently urged away from the mounting bracket 302.

Referring back to FIGS. 9 and 10, as the swing arm 40 moves toward the second position thereof (e.g., as the vehicle door 22 moves toward the fully open position thereof), one of the tangs 104' of the swing arm 40 engages the contacting tip portion 312 of the stop member 306. Continued movement of the swing arm 40 into the second position moves the stop member 306 against the bias of the biasing element 304. An outer periphery of the protrusion tang 104' is configured (e.g., formed with a rounded periphery) to allow the stop member 306 to move toward an un-displaced position thereof, as the swing arm 40 moves into the second position thereof (i.e., to partially return to the un-displaced position). As such, the swing arm 40 is resiliently retained in the second position thereof by the checking device 300. In order to move the swing arm 40 out of the second position thereof, a force must be directed on the swing arm 40 in a direction toward the first position thereof and of a sufficient magnitude to overcome the bias of the checking device 300. Consequently, the vehicle door 22 is resiliently retained in the fully open position by the checking device 300 such that a substantial force must be applied to the door 22 in a general direction toward the intermediate position thereof and of a sufficient magnitude to overcome the bias of the checking device 300.

Operation

Figure 12:
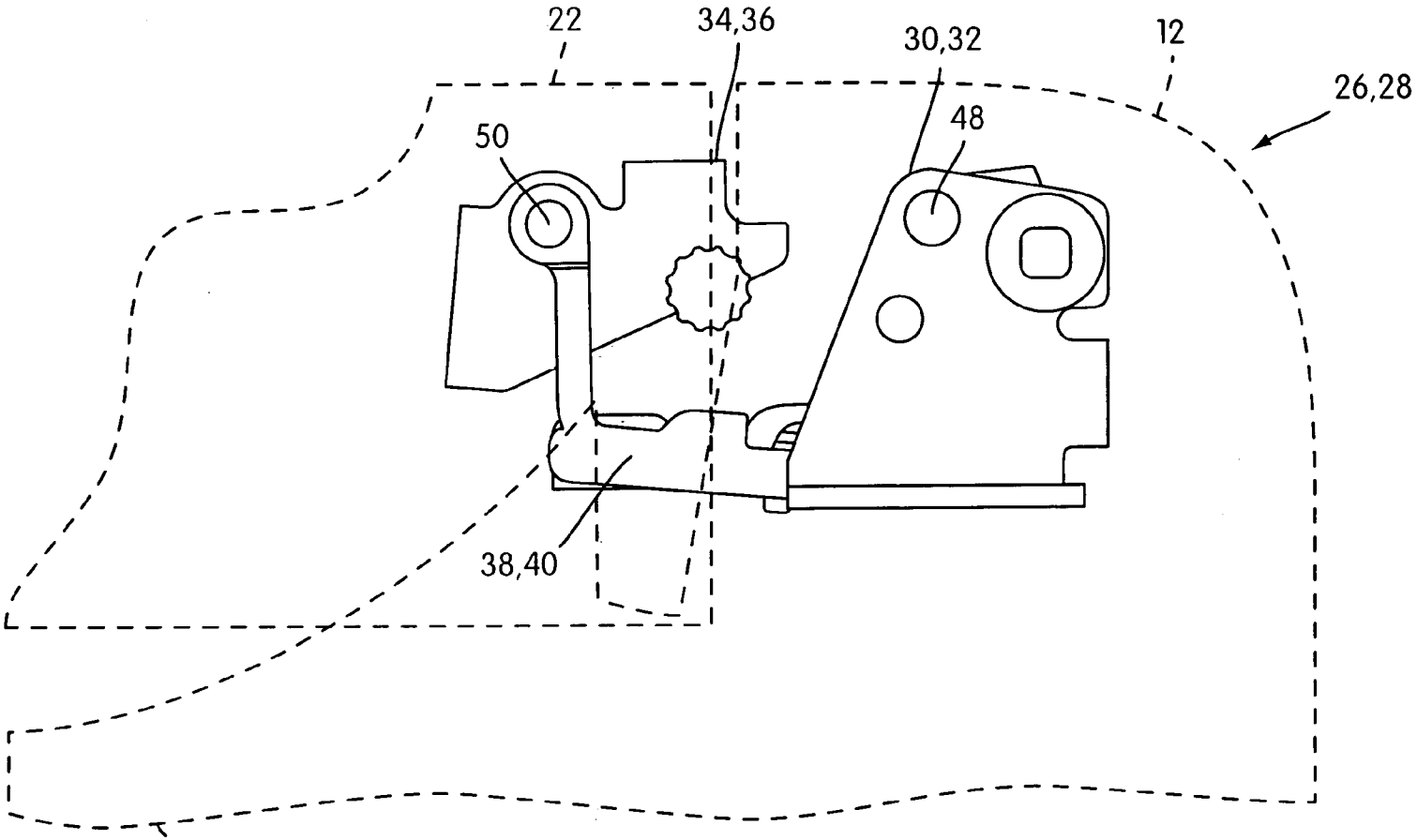
FIG. 12 is a top partial view of the vehicle shown in FIG. 1 showing the vehicle door in the fully closed position thereof.
Figure 13:
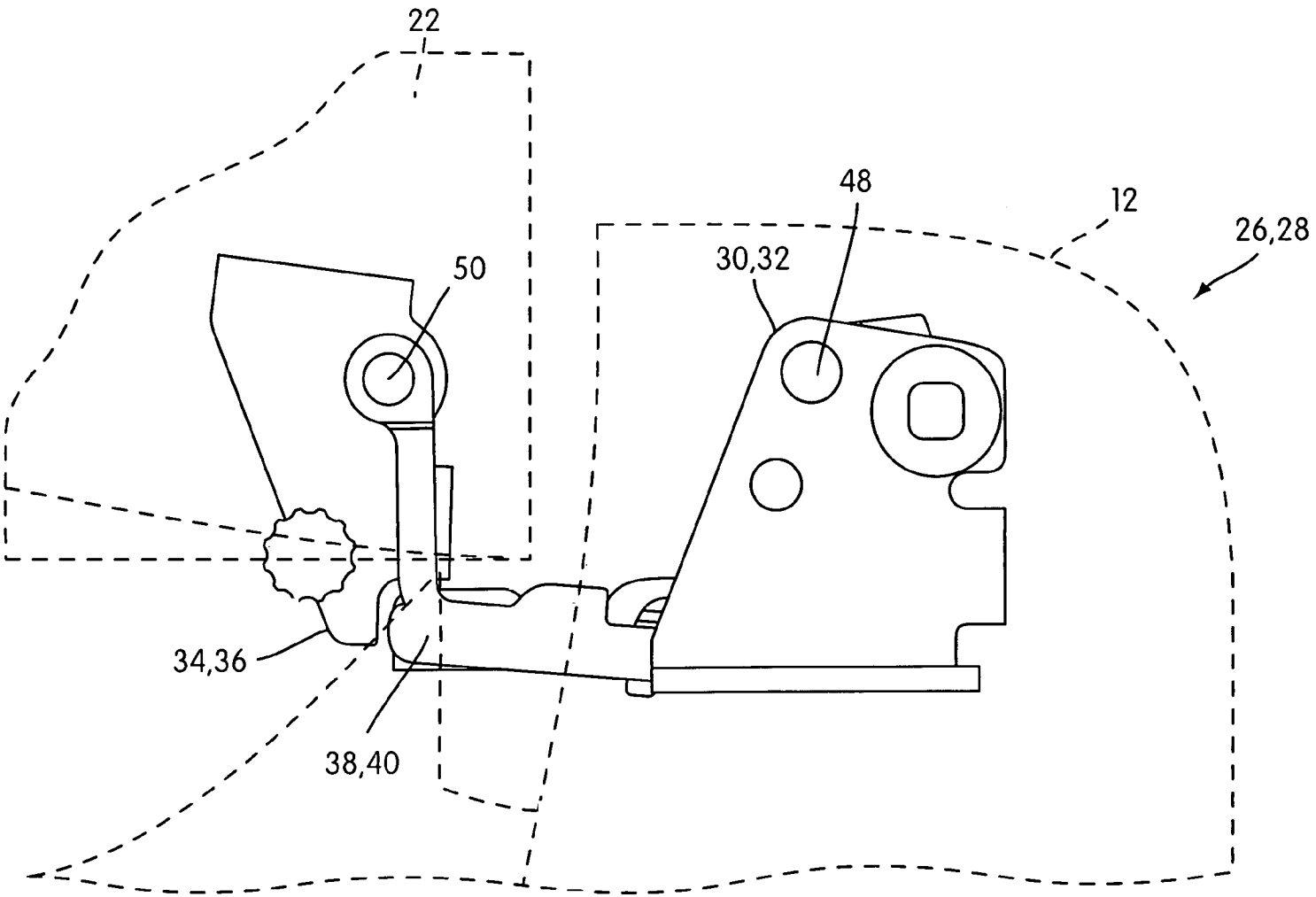
FIG. 13 is a top partial view similar to FIG. 12 showing the vehicle door in the intermediate position thereof.
Figure 14:
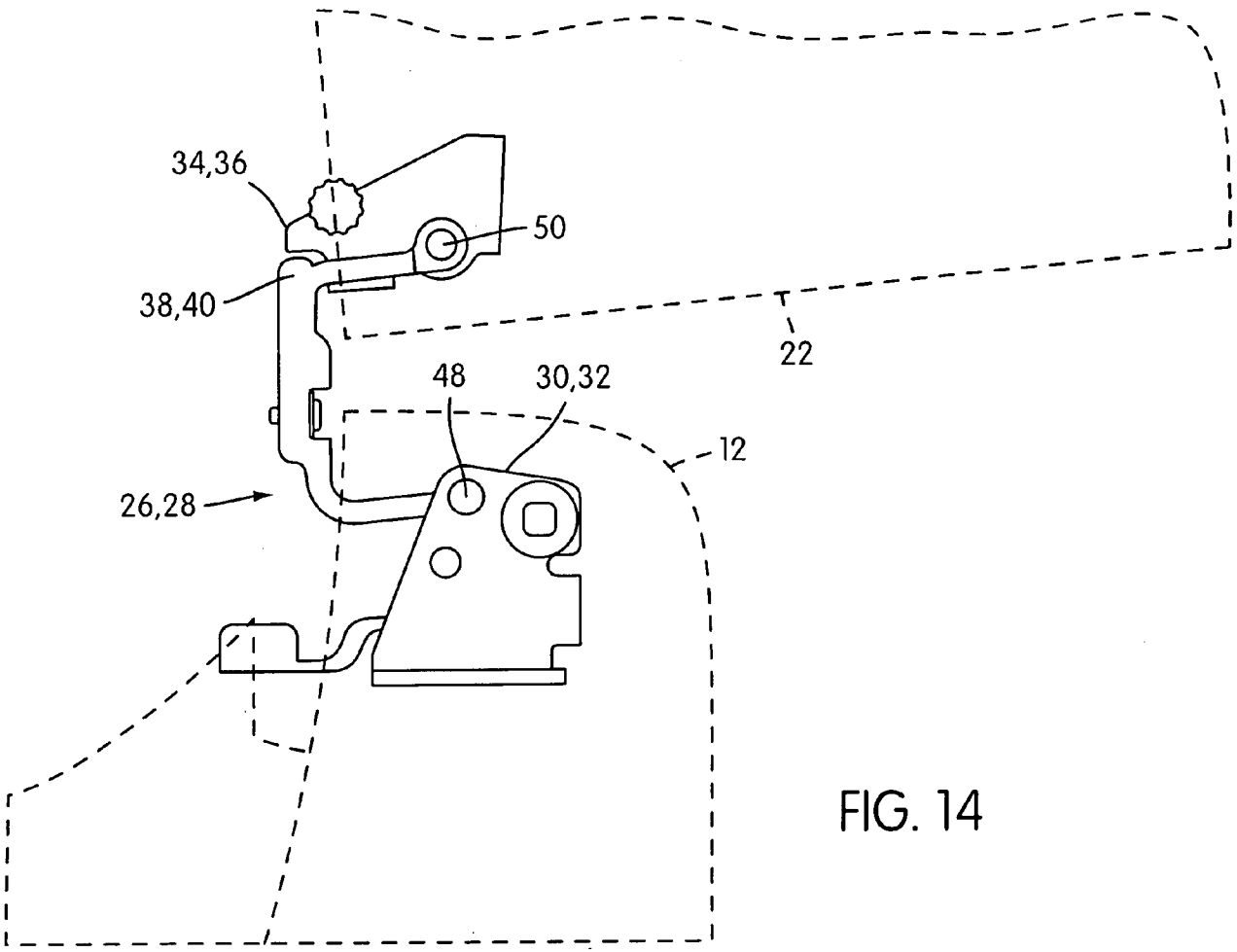
FIG. 14 is a top partial view similar to FIGS. 12 and 13 showing the vehicle door in the fully open position thereof.

FIGS. 12–14 respectively show the vehicle door 22 in the fully closed position, the intermediate position, and the fully open position. Shown in FIG. 12, the fully closed position of the vehicle door 22 is defined by the swing arms 38, 40 and the door mounting structures 34, 36 of the hinge assemblies 26, 28 being in respective first positions. The vehicle door 22 may be pivoted about the second axis 50 toward and into the intermediate position. Shown in FIG. 13, the intermediate position of the vehicle door 22 is defined by the swing arms 38, 40 being in their respective first positions, while the door mounting structures 34, 36 are in their respective second positions. As discussed above, the vehicle door 22 is rigidly obstructed from further pivotal movement about the axis 50 (toward the fully open position) between the engagement of the swing arms 38, 40 and respective stop surfaces 98. Additionally, the vehicle door 22 is resiliently biased within the intermediate position by the engagement between the check spring 134 and the biasing member 146 of the hinge assembly 28.

To move the vehicle door 22 out of intermediate position towards the fully open position, the release member 46, 46' must be manually actuated, thereby moving the latches 42, 44 into the released positions thereof. The door 22 may then be moved substantially unrestrictively toward the fully open position.

Just prior to moving into the fully open position, the checking device provides a resilient force that must be overcome to move the door 22 into the open position. The fully open position, shown in FIG. 14 is defined by the swing arms 38, 40 and the door mounting structures 34, 36 being in their respective second positions. The stop structures 81, 232 of the hinge assemblies 26, 28 provide a rigid stop for the door 22, which prevents further pivotal movement thereof past the fully open position. As discussed previously, the vehicle door 22 is resiliently retained in the fully open position by the engagement of the swing arm 40 and the checking device 300. As such, the vehicle door 22 stays in the fully open position until manually moved toward the intermediate position.

From the fully open position, the door 22 may be manually moved toward and into the fully closed position. It is noted that the release member 46, 46' need not be actuated when moving the door 22 toward the closed position. However, the resilient biasings of the checking device 300 in the fully open position and of the check spring 134 in the intermediate positions must be overcome while moving the door 22. It is also contemplated that the door 22 may be incrementally moved from the fully open position first into the intermediate position and then into the fully closed position without manually actuating the release member 46, 46'.

While the principles of the present invention have been made clear in the illustrative embodiments set forth above, it will be apparent to those skilled in the art that various modifications may be made to the structure, arrangement, proportion, elements, materials, and components used in the practice of the invention.

What is claimed is:

1. A door hinge system for supporting a vehicle door on a vehicle body, the vehicle door being movable to (a) a fully closed position wherein the door is positioned in covering relation with respect to a door opening in the vehicle body, (b) a fully opened position wherein the door is moved out of the covering relation and is positioned substantially alongside the vehicle body, and (c) an intermediate position between the fully open and fully closed positions wherein the door is moved out of the covering relation and extends generally outwardly away from the vehicle body, said hinge system comprising:

a pair of hinge assemblies, each of said hinge assemblies comprising: (a) a body mounting structure configured to be mounted to the vehicle body, (b) a door mounting structure configured to be mounted to the vehicle door, and (c) a dual pivot swing arm, said swing arms being respectively pivotally connected to said body mounting structures for relative pivotal movement about a first axis and also being respectively pivotally connected to said door mounting structures for relative pivotal movement about a second axis, each of said hinge assemblies including a swing arm latch, said latches being movable between a latched position and a released position, said latches being normally in said latched positions thereof;

at least one of said hinge assemblies providing a stop surface, said stop surface being positioned such that, when said door and body mounting structures are mounted to the vehicle door and body, respectively, movement of the vehicle door towards the fully open position is limited to pivotal movement about one of said first and second axes by said latches being in said latched positions thereof and then is stopped at the intermediate position by said stop surface so that movement of said latches to said released positions thereof and subsequent pivotal movement of the vehicle door about the other of said first and second axes is required to enable the door to be moved from the intermediate position to the fully open position; and a single manually operable release member operatively connected to each of said latches, said release member being manually movable to affect movement of each of said latches from said latched positions to said released positions thereof;

wherein a first of said swing arms includes a check member mounted thereto, said check member being engagable with a first door mounting structure upon pivotal movement of said swing arm about said first axis to thereby prevent further pivotal movement of said first door mounting structure about said second axis;

wherein said first door mounting structure provides a check member engaging portion engagable with said check member upon pivotal movement of said first swing arm about said first axis;

wherein said check member is pivotally mounted to said first swing arm and has a door mounting structure engaging portion on one end thereof and a vehicle body engaging portion on an opposite end thereof, said check member being configured and positioned such that said vehicle body engaging portion engages the vehicle body to maintain an unpivoted orientation of said check member, relative to said first swing arm, for positions of the vehicle door between and including said fully closed position and said intermediate position, said check member further configured and positioned such that upon pivotal movement of said first swing arm about said first axis, said check member is pivotable relative to said first swing arm such that said door mounting structure engaging portion engages said door mounting structure thereby preventing further pivotal movement of said door mounting structure relative to said swing arm.

2. A door hinge system according to claim 1, wherein in said fully closed position, the vehicle door is disposed at about a 0° angle relative to said door opening.

3. A door hinge system according to claim 1, wherein in said intermediate position, the vehicle door is disposed at about a 90° angle relative to said door opening.

4. A door hinge system according to claim 1, wherein in said fully open position, the vehicle door is disposed at about a 175° angle relative to said door opening.

5. A door hinge system according to claim 1, wherein said release member includes a ramped surface thereon, said release member being configured such that, as said body mounting structure returns to the closed position thereof, said a portion of the body mounting structure contacts and moves along said ramped surface, thereby effecting a camming movement of said release member, said camming movement simultaneously moving said latches into said latched positions thereof.

6. A door hinge system according to claim 1, wherein at least one of said pair of hinge assemblies includes a checking device configured with a biasing element to thereby resiliently resist movement from said fully open position.

7. A door hinge system according to claim 1, wherein one of said hinge assemblies includes a check spring mounted thereto that is engagable with a respective door mounting structure when the vehicle door is in said intermediate position to thereby resiliently resist movement of the vehicle door from said intermediate position.

8. A door hinge system according to claim 7, wherein said check spring is connectable to a respective swing arm, said first door mounting structure including a check spring engaging structure that is engagable with said check spring to thereby deflect said check spring as the vehicle door moves toward and into said intermediate position.

9. A door hinge system according to claim 1, wherein each of said hinge assemblies provides a stop surface, both said stop surfaces being positioned such that, when said door and body mounting structures are mounted to the vehicle door and body, respectively, movement of the vehicle door towards the fully closed position is limited to pivotal movement about said one of said first and second axes by said latch assemblies being in said latched positions thereof and then is stopped at the intermediate position by both said stop surfaces.

10. A door hinge system according to claim 9, wherein said stop surfaces are provided by said swing arms.

11. A door hinge system according to claim 10, wherein said door mounting structures each have a stop surface-engaging surface, the stop surfaces on said swing arms being positioned such that engagement of said stop surfaces with said stop surface-engaging surfaces stops the vehicle door at the intermediate position thereof.

12. A door hinge system according to claim 1, wherein said latches in said latched positions thereof prevent relative pivotal movement between said door mounting structures and said swing arms about said first axis and wherein said latches in said released positions thereof allow relative pivotal movement between said body mounting structures and said swing arms about said first axis.

13. A door hinge system according to claim 12, wherein said latches are respectively connected to said body mounting structures, said latches in said latched positions thereof engaging said swing arms to limit movement of the vehicle door towards the fully open position to pivotal movement about the second axis, said latches being disengagable from said swing arms to permit pivotal movement of the vehicle door about the first axis.

14. A door hinge system according to claim 13, wherein said latches are slidably mounted to said body mounting structures.

15. A door hinge system according to claim 14, wherein said latches slide generally rectilinearly between said latched position and said released position.

16. A door hinge system according to claim 15, wherein said one end of each of said swing arms defines a pair of tangs and wherein each of said latches has a corresponding pair of passageways, said tangs and said passageways being configured and positioned such that (a) when said latches are in said latched position said passageways are moved out of alignment with said tangs so that said one ends of said swing arms abut respective latches to thereby block pivotal movement of said swing arms relative to said door mounting structures about said first axis, and (b) when said latches are in said latched positions thereof, said passageways are moved into substantial alignment with said tangs to allow for pivotal movement of said swing arms relative to said door mounting structures about said first axis.

17. A door hinge system according to claim 13 further comprising a spring structure, wherein said spring structure biases said latches toward said latched position.

18. A door hinge system according to claim 17 further comprising a connecting member interconnecting said latches for movement together between said latched and released positions, said spring structure being a single spring that biases both said latches to said latched positions via said connecting member.

19. A door hinge system according to claim 18, wherein said spring is a coil spring and wherein one of said latches includes a radially extending flange member, said coil spring being disposed between said flange member and the body mounting structure associated with said one of said latches.

20. A door hinge system according to claim 18, wherein said one of said latches further includes a release member engaging portion, said manually operable release member being movably mounted to the body mounting structure associated with said one of said latches and being constructed and arranged to engage said release member engaging portion such that movement of said release member moves said one of said latches from said latched position toward and into said released position, thus also moving said second latch from said latched position toward and into said released position via said connecting member.

21. A door hinge system for supporting a vehicle door on a vehicle body, the vehicle door being movable to (a) a fully closed position wherein the door is positioned in covering relation with respect to a door opening in the vehicle body, (b) a fully opened position wherein the door is moved out of the covering relation and is positioned substantially alongside the vehicle body, and (c) an intermediate position between the fully open and fully closed positions wherein the door is moved out of the covering relation and extends generally outwardly away from the vehicle body, said hinge system comprising:

a pair of hinge assemblies, each of said hinge assemblies comprising: (a) a body mounting structure configured to be mounted to the vehicle body, (b) a door mounting structure configured to be mounted to the vehicle door, and (c) a dual pivot swing arm, said swing arms being respectively pivotally connected to said body mounting structures for relative pivotal movement about a first axis and also being respectively pivotally connected to said door mounting structures for relative pivotal movement about a second axis, each of said hinge assemblies including a swing arm latch, said latches being movable between a latched position and a released position, said latches being normally in said latched positions thereof;

at least one of said hinge assemblies providing a stop surface, said stop surface being positioned such that, when said door and body mounting structures are mounted to the vehicle door and body, respectively, movement of the vehicle door towards the fully open position is limited to pivotal movement about one of said first and second axes by said latches being in said latched positions thereof and then is stopped at the intermediate position by said stop surface so that movement of said latches to said released positions thereof and subsequent pivotal movement of the vehicle door about the other of said first and second axes is required to enable the door to be moved from the intermediate position to the fully open position; and a single manually operable release member operatively connected to each of said latches, said release member being manually movable to affect movement of each of said latches from said latched positions to said released positions thereof;

wherein said latches in said latched positions thereof prevent relative pivotal movement between said door mounting structures and said swing arms about said first axis and wherein said latches in said released positions thereof allow relative pivotal movement between said body mounting structures and said swing arms about said first axis;

wherein said latches are respectively connected to said body mounting structures, said latches in said latched positions thereof engaging said swing arms to limit movement of the vehicle door towards the fully open position to pivotal movement about the second axis, said latches being disengagable from said swing arms to permit pivotal movement of the vehicle door about the first axis.

22. A door hinge system according to claim 21, wherein in said fully closed position, the vehicle door is disposed at about a 0° angle relative to said door opening.

23. A door hinge system according to claim 21, wherein in said intermediate position, the vehicle door is disposed at about a 90° angle relative to said door opening.

24. A door hinge system according to claim 21, wherein in said fully open position, the vehicle door is disposed at about a 175° angle relative to said door opening.

25. A door hinge system according to claim 21, wherein at least one of said pair of hinge assemblies includes a checking device configured with a biasing element to thereby resiliently resist movement from said fully open position.

26. A door hinge system according to claim 21, wherein one of said swing arms includes a check member mounted thereto, said check member being engagable with a first door mounting structure upon pivotal movement of said swing arm about said first axis to thereby prevent further pivotal movement of said first door mounting structure about said second axis.

27. A door hinge system according to claim 26, wherein said first door mounting structure provides a check member engaging portion engagable with said check member upon pivotal movement of said first swing arm about said first axis.

28. A door hinge system according to claim 21, wherein one of said hinge assemblies includes a check spring mounted thereto that is engagable with a respective door mounting structure when the vehicle door is in said intermediate position to thereby resiliently resist movement of the vehicle door from said intermediate position.

29. A door hinge system according to claim 28, wherein said check spring is connectable to a respective swing arm, said first door mounting structure including a check spring engaging structure that is engagable with said check spring to thereby deflect said check spring as the vehicle door moves toward and into said intermediate position.

30. A door hinge system according to claim 2, wherein each of said hinge assemblies provides a stop surface, both said stop surfaces being positioned such that, when said door and body mounting structures are mounted to the vehicle door and body, respectively, movement of the vehicle door towards the fully closed position is limited to pivotal movement about said one of said first and second axes by said latch assemblies being in said latched positions thereof and then is stopped at the intermediate position by both said stop surfaces.

31. A door hinge system according to claim 30, wherein said stop surfaces ate provided by said swing arms.

32. A door hinge system according to claim 31, wherein said door mounting structures each have a stop surface-engaging surface, the stop surfaces on said swing arms being positioned such that engagement of said stop surfaces with said stop surface-engaging surfaces stops the vehicle door at the intermediate position thereof.

33. A door hinge system according to claim 21, wherein said latches arc slidably mounted to said body mounting structures.

34. A door hinge system according to claim 33, wherein said latches slide generally rectilinearly between said latched position and said released position.

35. A door hinge system according to claim 34, wherein said one end of each of said swing arms defines a pair of tangs and wherein each of said latches has a corresponding pair of passageways, said tangs and said passageways being configured and positioned such that (a) when said latches are in said latched position said passageways are moved out of alignment with said tangs so that said one ends of said swing arms abut respective latches to thereby block pivotal movement of said swing arms relative to said door mounting structures about said first axis, and (b) when said latches are in said latched positions thereof, said passageways are moved into substantial alignment with said tangs to allow for pivotal movement of said swing arms relative to said door mounting structures about said first axis.

36. A door hinge system according to claim 21 further comprising a spring structure, wherein said spring structure biases said latches toward said latched position.

37. A door hinge system according to claim 36 further comprising a connecting member interconnecting said latches for movement together between said latched and released positions, said spring structure being a single spring that biases both said latches to said latched positions via said connecting member.

38. A door hinge system according to claim 37, wherein said spring is a coil spring and wherein one of said latches includes a radially extending flange member, said coil spring being disposed between said flange member and the body mounting structure associated with said one of said latches.

39. A door hinge system according to claim 37, wherein said one of said latches further includes a release member engaging portion, said manually operable release member being movably mounted to the body mounting structure associated with said one of said latches and being constructed and arranged to engage said release member engaging portion such that movement of said release member moves said one of said latches from said latched position toward and into said released position, thus also moving said second latch from said latched position toward and into said released position via said connecting member.

40. A door hinge system for supporting a vehicle door on a vehicle body, the vehicle door being movable to (a) a fully closed position wherein the door is positioned in covering relation with respect to a door opening in the vehicle body, (b) a fully opened position wherein the door is moved out of the covering relation and is positioned substantially alongside the vehicle body, and (c) an intermediate position between the fully open and fully closed positions wherein the door is moved out of the covering relation and extends generally outwardly away from the vehicle body, said hinge system comprising:

a pair of hinge assemblies, each of said hinge assemblies comprising: (a) a body mounting structure configured to be mounted to the vehicle body, (b) a door mounting structure configured to be mounted to the vehicle door, and (c) a dual pivot swing arm, said swing arms being respectively pivotally connected to said body mounting structures for relative pivotal movement about a first axis and also being respectively pivotally connected to said door mounting structures for relative pivotal movement about a second axis, each of said hinge assemblies including a swing arm latch, said latches being movable between a latched position and a released position, said latches being normally in said latched positions thereof;

at least one of said hinge assemblies providing a stop surface, said stop surface being positioned such that, when said door and body mounting structures are mounted to the vehicle door and body, respectively, movement of the vehicle door towards the fully open position is limited to pivotal movement about one of said first and second axes by said latches being in said latched positions thereof and then is stopped at the intermediate position by said stop surface so that movement of said latches to said released positions thereof and subsequent pivotal movement of the vehicle door about the other of said first and second axes is required to enable the door to be moved from the intermediate position to the fully open position; and a single manually operable release member operatively connected to each of said latches, said release member being manually movable to affect movement of each of said latches from said latched positions to said released positions thereof wherein said release member includes a ramped surface thereon, said release member being configured such that, as said body mounting structure returns to the closed position thereof, a portion of the body mounting structure contacts and moves along said ramped surface, thereby effecting a camming movement of said release member, said camming movement simultaneously moving said latches into said latched positions thereof.

41. A door hinge system according to claim 40, wherein in said fully closed position, the vehicle door is disposed at about a 0° angle relative to said door opening.

42. A door hinge system according to claim 40 wherein in said intermediate position, the vehicle door is disposed at about a 90° angle relative to said door opening.

43. A door hinge system according to claim 40 wherein in said fully open position, the vehicle door is disposed at about a 175° angle relative to said door opening.

44. A door hinge system according to claim 40, wherein at least one of said pair of hinge assemblies includes a checking device configured with a biasing element to thereby resiliently resist movement from said fully open position.

45. A door hinge system according to claim 40, wherein one of said hinge assemblies includes a check spring mounted thereto that is engagable with a respective door mounting structure when the vehicle door is in said intermediate position to thereby resiliently resist movement of the vehicle door from said intermediate position.

46. A door hinge system according to claim 45, wherein said check spring is connectable to a respective swing arm, said first door mounting structure including a check spring engaging structure that is engagable with said check spring to thereby deflect said check spring as the vehicle door moves toward and into said intermediate position.

47. A door hinge system according to claim 40, wherein each of said hinge assemblies provides a stop surface, both said stop surfaces being positioned such that, when said door and body mounting structures are mounted to the vehicle door and body, respectively, movement of the vehicle door towards the fully closed position is limited to pivotal movement about said one of said first and second axes by said latch assemblies being in said latched positions thereof and then is stopped at the intermediate position by both said stop surfaces.

48. A door hinge system according to claim 47, wherein said stop surfaces are provided by said swing arms.

49. A door hinge system according to claim 48, wherein said door mounting structures each have a stop surface-engaging surface, the stop surfaces on said swing arms being positioned such that engagement of said stop surfaces with said stop surface-engaging surfaces stops the vehicle door at the intermediate position thereof.

50. A door hinge system according to claim 40, wherein said latches in said latched positions thereof prevent relative pivotal movement between said door mounting structures and said swing arms about said first axis and wherein said latches in said released positions thereof allow relative pivotal movement between said body mounting structures and said swing arms about said first axis.

51. A door hinge system according to claim 50, wherein said latches are respectively connected to said body mounting structures, said latches in said latched positions thereof engaging said swing arms to limit movement of the vehicle door towards the fully open position to pivotal movement about the second axis, said latches being disengagable from said swing arms to permit pivotal movement of the vehicle door about the first axis.

52. A door hinge system according to claim 51, wherein said latches are slidably mounted to said body mounting structures.

53. A door hinge system according to claim 52, wherein said latches slide generally rectilinearly between said latched position and said released position.

54. A door hinge system according to claim 53, wherein said one end of each of said swing arms defines a pair of tangs and wherein each of said latches has a corresponding pair of passageways, said tangs and said passageways being configured and positioned such that (a) when said latches are in said latched position said passageways are moved out of alignment with said tangs so that said one ends of said swing arms abut respective latches to thereby block pivotal movement of said swing arms relative to said door mounting structures about said first axis, and (b) when said latches are in said latched positions thereof, said passageways are moved into substantial alignment with said tangs to allow for pivotal movement of said swing arms relative to said door mounting structures about said first axis.

55. A door hinge system according to claim 40 further comprising a spring structure, wherein said spring structure biases said latches toward said latched position.

56. A door hinge system according to claim 55 further comprising a connecting member interconnecting said latches for movement together between said latched and released positions, said spring structure being a single spring that biases both said latches to said latched positions via said connecting member.

57. A door hinge system according to claim 56, wherein said spring is a coil spring and wherein one of said latches includes a radially extending flange member, said coil spring being disposed between said flange member and the body mounting structure associated with said one of said latches.

58. A door hinge system according to claim 56, wherein said one of said latches further includes a release member engaging portion, said manually operable release member being movably mounted to the body mounting structure associated with said one of said latches and being constructed and arranged to engage said release member engaging portion such that movement of said release member moves said one of said latches from said latched position toward and into said released position, thus also moving said second latch from said latched position toward and into said released position via said connecting member.

59. A door hinge system according to claim 40, wherein one of said swing arms includes a check member mounted thereto, said check member being engagable with a first door mounting structure upon pivotal movement of said swing arm about said first axis to thereby prevent further pivotal movement of said first door mounting structure about said second axis.

60. A door hinge system according to claim 59, wherein said first door mounting structure provides a check member engaging portion engagable with said check member upon pivotal movement of said first swing arm about said first axis.

61. A door hinge system according to claim 60, wherein said check member is pivotally mounted to said first swing arm and has a door mounting structure engaging portion on one end thereof and a vehicle body engaging portion on an opposite end thereof, said check member being configured and positioned such that said vehicle body engaging portion engages the vehicle body to maintain an unpivoted orientation of said check member, relative to said first swing arm, for positions of the vehicle door between and including said fully closed position and said intermediate position, said check member further configured and positioned such that upon pivotal movement of said first swing arm about said first axis, said check member is pivotable relative to said first swing arm such that said door mounting structure engaging portion engages said door mounting structure thereby preventing further pivotal movement of said door mounting structure relative to said swing arm.

* * * * *

UNITED STATES PATENT AND TRADEMARK OFFICE

CERTIFICATE OF CORRECTION

PATENT NO. : 7,096,538 B2
APPLICATION NO. : 10/225456
DATED : August 29, 2006
INVENTOR(S) : Chuan Liang et al.

It is certified that error appears in the above-identified patent and that said Letters Patent is hereby corrected as shown below:

On title page, item (73) Assignee address:
Replace "Bedford"
with --Bradford, Ontario--.

Signed and Sealed this

Twenty-first Day of November, 2006

JON W. DUDAS
*Director of the United States Patent and Trademark Office*